US005143295A

United States Patent [19]

Okayama et al.

[11] Patent Number: 5,143,295

[45] Date of Patent: Sep. 1, 1992

[54] BUBBLY WATER OUTLET DEVICE

[75] Inventors: Kenji Okayama; Yoshitaka Oba; Masahiko Imazono; Masatoshi Enoki; Masao Shimizu; Yoshiki Ohta; Koji Nakano; Eiji Matsuda; Osamu Tokunaga; Tomoaki Nakano; Hachihei Watanabe; Toshihide Ushita, all of Fukuoka, Japan

[73] Assignee: Toto Ltd., Fukuoka, Japan

[21] Appl. No.: 614,905

[22] Filed: Nov. 16, 1990

[30] Foreign Application Priority Data

Nov. 21, 1989 [JP] Japan ..... 1-304491
Nov. 24, 1989 [JP] Japan ..... 1-305079

[51] Int. Cl.[5] ..... B05B 1/08; B05B 1/18; B05B 7/00

[52] U.S. Cl. ..... 239/403; 239/428.5; 239/432; 239/553.5

[58] Field of Search ..... 239/399, 403, 405, 428.5, 239/432, 463, 553.3, 553.5, 59.05

[56] References Cited

U.S. PATENT DOCUMENTS

| | | | |
|---|---|---|---|
| 1,976,062 | 10/1934 | Estep | 239/428.5 |
| 2,570,669 | 10/1951 | Hannigan | 239/428.5 |
| 2,935,265 | 5/1960 | Richter | 239/428.5 |
| 2,962,226 | 11/1960 | Goodrie | 239/428.5 |
| 3,321,140 | 5/1967 | Parkison et al. | 239/428.5 |
| 4,346,844 | 8/1982 | Harmony | 239/428.5 |
| 4,542,853 | 9/1985 | Diamond | 239/428.5 |

FOREIGN PATENT DOCUMENTS

| | | | |
|---|---|---|---|
| 293636 | 12/1953 | Switzerland | 239/590.5 |

*Primary Examiner*—Andres Kashnikow
*Assistant Examiner*—Lesley D. Morris
*Attorney, Agent, or Firm*—Jordan and Hamburg

[57] ABSTRACT

A bubbly water outlet device comprises a swirl chamber which is connected to a water supply source and is adapted to swirl a flow, and a bubbler chamber which is connected to the swirl chamber through a discharge port provided substantially at a center of the swirl chamber. The bubbler chamber is adapted to suck air from an exterior by virtue of the inflow of water from the discharge port and is capable of discharging bubbly water.

24 Claims, 30 Drawing Sheets

BUBBLY WATER OUTLET DEVICE

BACKGROUND OF THE INVENTION

1. Field of the Invention

The present invention relates to a bubbly water outlet device attached to an end of a spout of a faucet, shower head or the like for making bubbles in the water flow.

2. Description of the Prior Art

There have been such faucets which are provided with bubbly water outlet for reducing flowing noises and splashing noises in sinks or the like and/or to reduce splashes. One of popular outlets is disclosed in Japanese Patent Publication (KOKOKU) No. 63-31621.

FIG. 66 is a sectional view schematically illustrating a bubbly water outlet which is disclosed in the above publication and is also of a conventional type. In the Figure, an outlet cap 901 is fixed to an end of a spout 900 of a faucet, and accommodates a pressure reducing plate 902 provided with many small holes 902*a*. At a downstream side to the pressure reducing plate 902, a peripheral wall of the outlet cap 901 is provided with air holes 903 for introducing external air into supplied water, and a plurality of baffle nets 904 for straightening a water flow is also provided at an outlet end.

In this bubbly water outlet, the water from the spout 900 is accelerated as it passes through the small holes 902*a* in the pressure reducing plate 902. Thereby, a pressure at a portion downstream of the pressure reducing plate 902 and inside the outlet cap 901 is reduced, so that the external air is sucked therein through the air holes 903, and thus the air is mixed with the water, resulting in bubbling of the water. Since the baffle net 904 has fine meshes, the water is intensely stirred as it collides with the baffle net 904 and flows through it, which also promotes the bubbling.

However, since the water from the spout 900 flows through the holes 902*a* in the pressure reducing plate 900, pressure loss is caused in the flow. It is therefore necessary to open the faucet equal to or wider than an appropriate degree for obtaining an appropriate discharge pressure, otherwise comfortable use and sufficient bubbling can not be achieved.

Since two members, i.e., the pressure reducing plate 902 and the baffle net 904 are arranged, debris in the water may close them and/or scale may stick to them. Therefore, a flow passage area may be reduced, resulting in insufficient discharging, and particularly, the bubbling can not be appropriately effected if the holes 902*a* are closed.

As described above, the conventional bubbly water outlet has utilized the acceleration of the flow by means of the pressure reducing plates and the suction of the external air owing to the pressure reduction in the internal flow passage caused by the acceleration, so that problems such as the pressure loss and closure of the passages can not be avoided.

Further, the bubbly water from the outlet cap 901 arranged at the end of the spout 900 has a size or a diameter which is determined by the cap 901. Therefore, if the cap 901 has a diameter similar to that of the spout 900, the discharged flow has a spread similar to that when the the water is discharged without being bubbled. On the other hand, since the bubbling softens the flow, it can be appropriately used in the shower bath or the like. However, the small discharge area, which is suitable for the spout, is not suitable for the shower bath.

As can be seen from this conventional example, it has been difficult in the conventional structures to bubble the water without limitations with respect to the flow rate, and to maintain a suitable condition for the use without vanishing the bubbles in the water flow. In addition to these problems, there are various problems in appropriately effecting the bubbling of the water.

If several functions such as bubbling the water, straightening the flow and discharging an ordinary flow are incorporated in one faucet, it unavoidably is larger. For example, since it is necessary to arrange passages and holes for introducing the external air into a bubble forming mechanism part, additional passage for the ordinary flow must be disposed at a position avoiding these air passages. Due to such limitations with respect to the design, the structures in which the bubbly flow and a concentrated flow can be selectively used is independently provided with the air passages for the bubbling and the passages for the concentrated flow, resulting in a large size of the outlet opening. Therefore, the device is too large for use as hand sprays in kitchens or the like, which causes problems in handling thereof and also causes various disadvantages in other applications.

SUMMARY OF THE INVENTION

Accordingly, it is an object of the invention to provide a water outlet device, in which a sufficient flow rate can be ensured without causing pressure loss and clogging by debris, appropriate bubbling can always be achieved, and a flow area can be enlarged for appropriate use in a shower bath or the like, and in addition to increased bubbling efficiency, the structure also is suitable as a faucet. The present invention also has an object to provide a water outlet device having compact structures in which bubbly, straight and ordinary flows can be easily selected.

BRIEF DESCRIPTION OF THE DRAWINGS

Embodiments of the invention will now be described by way of example only, with reference to the accompanying drawings, in which:

FIG. 10(*b*) is a cross sectional view;

FIG. 10(*c*) is a longitudinally sectional view schematically illustrating a relationship in levels of three holes;

FIG. 24(*b*) is a perspective view of a distributor plate having an annular nonreturn plate fixed to an upper end thereof;

FIG. 49(*b*) is a plan view thereof;

FIG. 50(*b*) is a plan view;

DETAILED DESCRIPTION CF THE PREFERRED EMBODIMENTS

Figure 1:
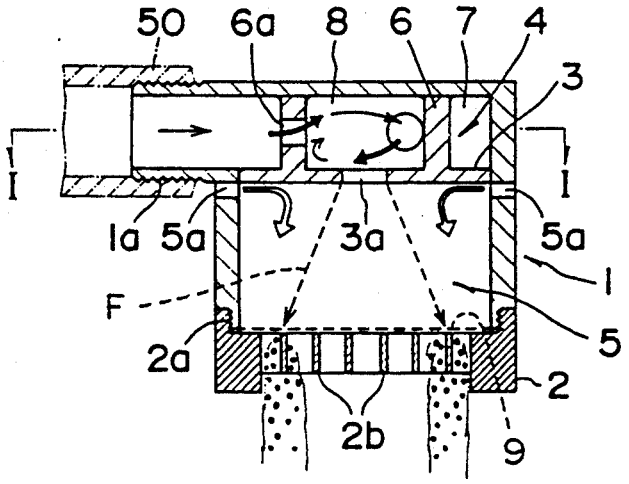
FIG. 1 is a longitudinally sectional view of a major part of a bubbly water outlet device of an embodiment of the invention.
Figure 2:
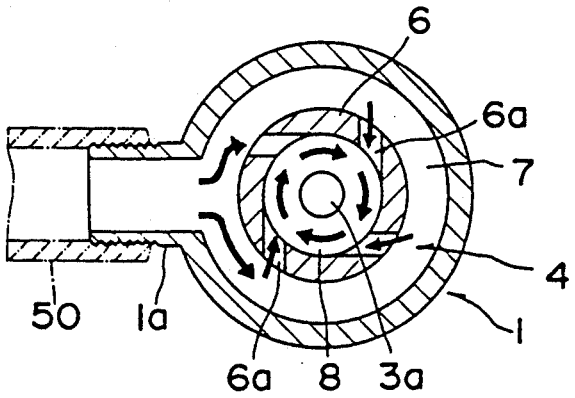
FIG. 2 is a sectional view taken along lines I—I in FIG. 1.

Referring to the FIGS. 1 and 2, which are a longitudinally sectional view of a major part of a bubbly water outlet device of an embodiment of the invention, and a sectional view taken along lines I—I in FIG. 1, an outlet head 1 for bubbling or making bubbles in water is attached to an end of a spout 50. The outlet head 1 has a circular cross section, as shown in FIG. 2, and is provided at an upper portion with a radially projected pipe 1*a* for connecting to a spout 50. A passage which extends nearly horizontally in the connector pipe 1*a* is bent at a right angle in a center of the outlet head 1 to form an internal passage extending to a distributor plate 2 at a lower end.

An interior of the outlet head 1 is divided by a partition 3 into an upper swirl chamber 4 and a lower bubbler chamber 5. The swirl chamber 4 is divided into an upstream chamber 7 and a downstream chamber 8 by an annular wall 6 extending between the partition 3 and an upper inner wall of the outlet head 1. The upstream chamber 7 is in communication with the connector pipe 1*a*and the downstream chamber 8 is in communication with the bubbler chamber 5 through a discharge port 3*a* formed at the partition 3. The partition 3 and the annular wall 6 are integrally formed, and are fixedly assembled in the outlet head 1.

The annular wall 6 is coaxial with a cross section of the passage in the outlet head 1, and is provided at four portions with holes 6*a*. There holes 6*a* are arranged to form stream lines which are tangential with respect to a cross section of the downstream chamber 8 inside the annular wall 6. The discharge port 3*a* opening at the bottom of the downstream chamber 8 is located at the center of the downstream chamber 8 and has an inner diameter remarkably smaller than an inner diameter of the downstream chamber 8.

A peripheral wall of the bubbler chamber 5 is provided with air holes 5*a* through which air is sucked to make bubbles in the water. The bubbler chamber 5 has enough height and inner diameter for sufficiently bubbling the water discharged from the port 3*a* by the air injected through the air holes 5*a*.

The distributor plate 2 is attached to the lower end of the outlet head 1 by a thread engagement 2*a* with a net 9 for promoting the bubbling therebetween. The distributor plate 2 incorporates a baffle plate 2*b* for rapidly discharging the bubbly water.

Figure 3A:
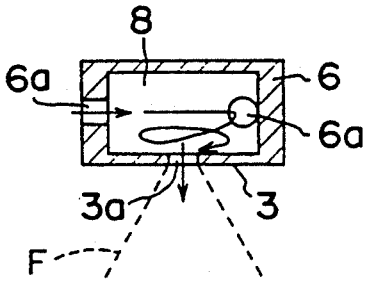
FIG. 3(*a*) is a longitudinally sectional view illustrating generation of a swirl flow inside an annular wall.
FIG. 3*b*) is a cross sectional view.
Figure 3B:
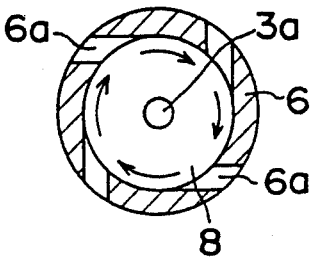

The water fed from the spout 50 flows from the upstream chamber 7 through the holes 6*a* in the annular wall 6 into the downstream chamber 8. Since the holes 6*a* have the axes in the tangential direction with respect to the downstreaam chamber 8 having a circular section, the water flowed into the downstream chamber 8 forms a swirl or swirling flow. Thus, as shown in FIG. 3, the water flows from the periphery of the downstream chamber 8 along the inner wall, and the flows of water from the four holes 6*a* join together to form the swirl in the downstream chamber 8. In this operation, if the total passage area or the holes 6*a* is larger than that of the discharge port 3*a*, the water stagnates in the downstream chamber 8, which slightly increases the pressure. Therefore, a flowing energy of the water itself is increased in the downstream chamber and a centrifugal force is generated by the swirl. Thus, the water flowing downwardly through the discharge port 3*a* tends to spread radially outwardly due to the centrifugal force, and is discharged to form a conical water film F or screen, as shown by a dashed line in the Figure. Thus, the flow of the water from the discharge port 3*a* does not form a cylindrical flow, but the conical water film F is formed by the continuous flow of the water diverged radially outwardly by the centrifugal force of the water itself. A thickness of the water film F decreases as a distance from the discharge port 3*a* increases, and the film F collides with the net 9 at the lower end of the bubbler chamber 5.

The discharge port 3*a* is located nearly at the center of the bubbler chamber 5, and the water biased by the centrifugal force flows at a high velocity therethrough, so that pressure in a space outside the conical water film F is reduced. Thereby, the air is sucked through the air holes 5*a* and is mixed into the water dispersed by the collision with the net 9, and thus the bubbly water is produced.

Figure 4:
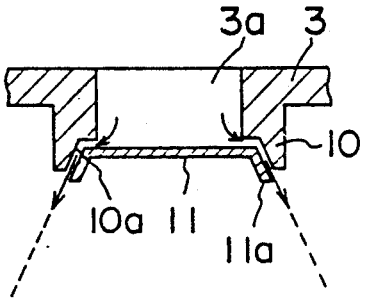
FIG. 4 is a longitudinally sectional view illustrating an embodiment for forming a water film utilizing a guide.

The flow of the bubbly water thus produced is straightened as it passes through the baffle plate 2*b* in the distributor plate 2, and is discharged from the outlet head 1. FIG. 4 is a fragmentary sectional view illustrating an another structure of the discharge port 3*a* for forming the conical water film.

Referring to FIG. 4, the discharge port 3*a* is surrounded by a downwardly extended discharge pipe 10, and a guide 11 is attached to an inner periphery of a lower end thereof by a nonillustrated connecting member. The inner periphery of the lower end of the discharge pipe 10 forms an inclined portion 10*a* which diverges downwardly, the guide 11 has a tapered surface 11*a* complementary to this inclined portion 10*a*. A space between the inclined portion 10*a* and the tapered surface 11*a* has a configuration of a truncated conical, which contributes to form the conical water film discharged into the bubbler chamber 5.

The structure of this discharge port 3*a* may be employed instead of that shown in FIG. 1, in which case the guide 11, in addition to the centrifugal force in the swirl chamber 4, contributes to guide and diverge the water flow, so that the stable water film F is produced. Further, if the swirl chamber 4 is not employed, and thus the water is directly supplied through the discharge port 3*a*, the water flow can sufficiently diverged, and thus the water film F can be formed.

Figure 5:
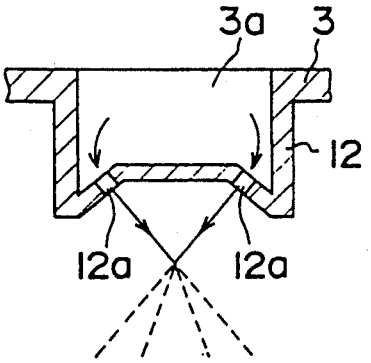
FIG. 5 is a sectional view illustrating an embodiment for forming a dispersed flow by a converging flow.

Further, as shown in FIG. 5, such a structure may be employed so that water flows are intensely joined together in the bubbler chamber 5 to disperse it, rather than forming the water film.

In FIG. 5, the outer periphery of the discharge port 3*a* is extended, similarly to the structure in FIG. 4, to form a discharge pipe 12 which is provided at a lower end thereof with a plurality of holes 12*a*, all of which are directed toward the center line of the discharging port 3*a*. The water from the discharge port 3 is discharged along the axes of the ports 12*a*, and flows to join together at the axis of the discharge port 3. Therefore, the joined water is dispersed in the bubbler chamber 5, as indicated by a dashed line, and collides with the net 9 or the inner wall of the bubbler chamber 5, so that the bubble formation can be ensured.

Figure 6:
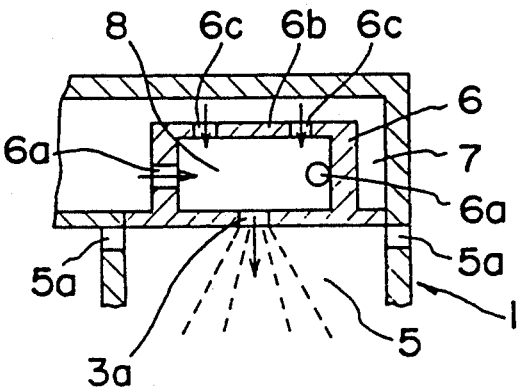
FIG. 6 is a sectional view illustrating an embodiment for forming a dispersed flow by utilizing an annular wall.

FIG. 6 illustrates another embodiment of a structure, in which dispersion of the water in the bubbler chamber 5 can be carried out. As compared with the structure in FIG. 1, this structure has such differences that a top plate 6*b* is provided at the upper end of the annular wall 6 to form the downstream chamber 8 separated from the upstream chamber 7, and the top plate 6*b* is provided with holes 6*c*.

The water flows through the holes 6*a* and 6*c* into the downstream chamber 8, and the swirling flow is formed by the water from the holes 6*a* in tangential directions. The water also flows through the holes 6*c* in the top plate 6*b*, which generate a flow to push the water having the centrifugal force toward the discharge port 3*a*. Therefore, the water from the discharge port 3*a* does not form a water film, which is formed in the structure in FIG. 1, but the flow of water is torn off by a pushing action applied from the water from the discharging port 3*a*, and thus is discharged and dispersed from the discharge port 3*a*, as shown by a dashed line.

As above, according to the structure of FIG. 6, the water dispersed from the discharged port 3*a* is uniformly distributed not only to the inner surface of the bubbler chamber 5 but to the center area thereof.

In addition to the structures in the above embodiments, various structures can be applied for swirling the water in the swirl chamber 4 and for bubbling it in the bubbler chamber 5.

Figure 7:
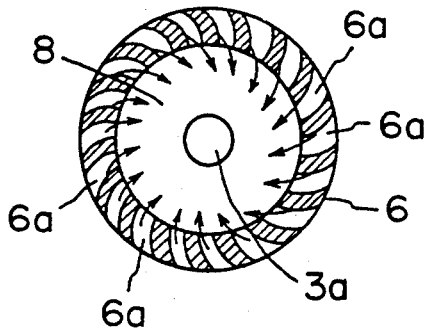
FIG. 7 is a cross sectional view of a major part of an embodiment in which radially arranged holes are provided in an annular wall so as to generate a swirling flow.

FIG. 7 is a cross sectional view of another embodiment of the holes 6*a* provided in the annular wall 6. The holes 6*a* have axes inclined so as to introduce the water from the upstream chamber 7 through the holes 6*a* toward the center of the annular wall 6, and the number thereof is larger than that of the holes 6*a* in FIG. 2. By the holes 6*a* thus opened, the flows of water introduced through the respective holes 6*a* into the downstream chamber 8 join together and form the swirling flow in the downstream chamber 8. This swirling flow can function, similarly to the above embodiment, to discharge the water in the form of the conical water film from the discharge port 3*a*. Since the number of the holes 6*a* is relatively large, the structure can be utilized even for a large flow rate.

Figure 8A:
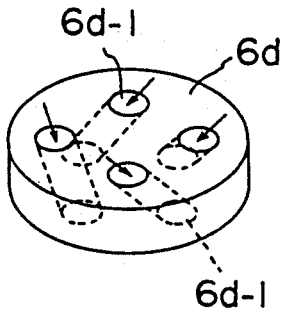
FIGS. 8(*a*) and 8(*b*) are schematic views illustrating an embodiment in which holes in twisted positions are formed in a flat partition.
Figure 8B:
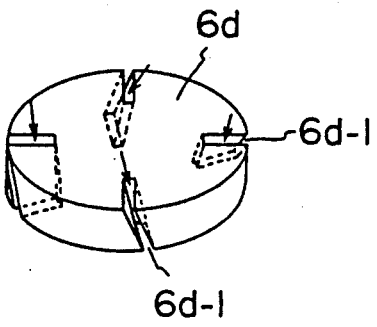

FIGS. 8(*a*) and 8(*b*) show another structure for swirling the flow in the downstream chamber 3, in which the partition is formed as a flat plate and is disposed so as to divide the swirl chamber 4 into the upstream chamber 7 and the downstream chamber 8, and the partition has holes which produce a swirling flow in the downstream chamber 8. In FIG. 8(*a*), the four holes 6*d*-1 have the axes which are twisted with respect to the axis of the partition 3 so as to direct the flows toward the discharge port 3*a* and to swirl them. As shown in FIG. 8(*b*), the holes 6*d*-1 may be slit-like recesses, which are also twisted with respect to the axis of the partition 3. In the structure, in which the partition 3 divides the interior into two parts at supply side and discharge side, the supplied water can be swirled in the downstream chamber 8 for discharging it in the form of the water film from the distribution hole 2*c*, if the axes of the holes 6*d*-1 are appropriately determined.

Figure 9:
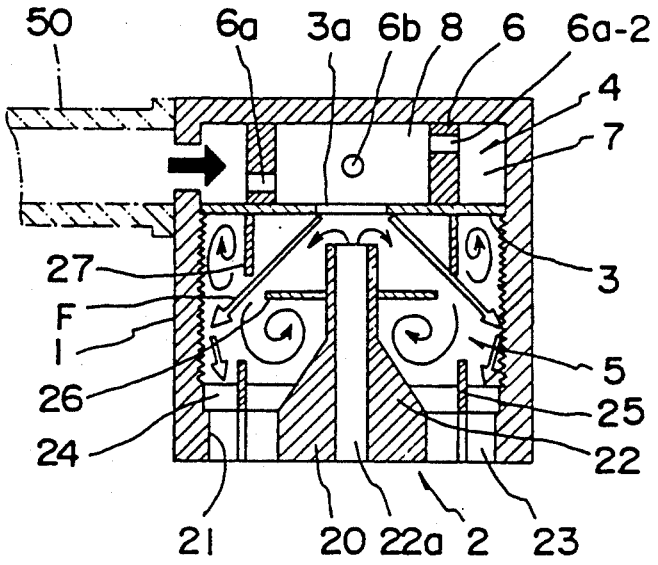
FIG. 9 is a longitudinally sectional view of a major part of another embodiment of a bubbly water outlet device in which holes are formed at different levels in an annular wall.
Figure 10A:
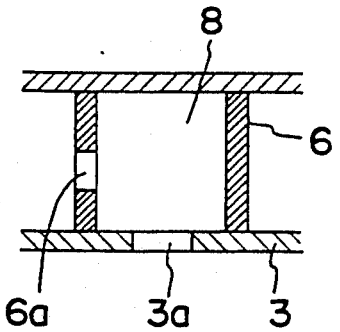
FIG. 10(*a*) is a longitudinally sectional view schematically illustrating positions of holes formed in an annular wall.
Figure 10B:
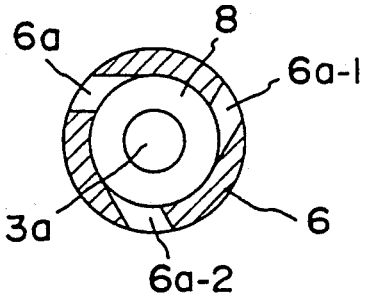
Figure 10C:
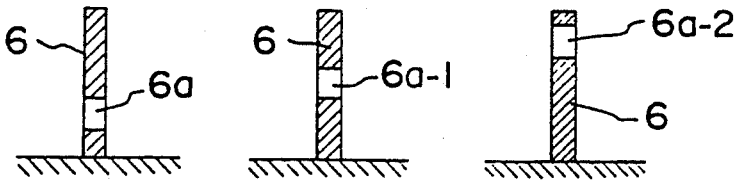

FIG. 9 shows another embodiment of the three holes 6*a* to 6*c* each of which locates at different level, and FIG. 10 shows a schematic view or the arrangement of these holes 6*a* to 6*c*. The members indicated by the numerals 20's will be described as to FIG. 23.

As shown in FIG. 10(*b*), the annular wall 6 is provided with the three holes 6*a*, 6*a*1 and 6*a*-2, similarly to the aforementioned embodiments, and the discharge port 3*a* is located at the center of the bottom of the downstream chamber 8. For example, if the downstream chamber 8 has an inner diameter of 18 mm, the discharge port 3*a* has an inner diameter of about 8 mm, the holes 6*a*, 6*a*-1 and 6*a*-2 have inner diameters of about 5 mm, and the annular wall 6 has a thickness of about 3 mm.

These holes 6*a*, 6*a*-1 and 6*a*-2 are located at different levels from the bottom of the downstream chamber 8, as shown in FIG. 10(*c*). That is; the hole 6*a* at the upstream side is located at a lower level, and the holes 6*a*-1 and 6*a*-2 which are aligned in a clockwise direction in FIG. 10(*b*) are located at middle and higher levels, respectively. This relationship of the levels of the holes 6*a*, 6*a*-1 and 6*a*-2 is not essential, and it is essential only to arrange the holes 6*a*, 6*a*-1 and 6*a*-2 in different levels. The holes 6*a*, 6*a*-1 and 6*a*-2 at the different levels contribute to reduce the interference of the flows of the water supplied into the downstream chamber 8 therethrough, and thus the flows from the holes 6*a*, 6*a*-1 and 6*a*-2 can sufficiently maintain the swirl along the peripheral wall of the downstream chamber 8. If the holes 6*a*, 6*a*-1 and 6*a*-2 are located at a same level, the flows from the respective holes 6*a*, 6*a*-1 and 6*a*-2 are disturbed by the flow(s) from the other hole(s), and thus the swirling force is reduced. However, since the positions for supplying the water are vertically deviated in the embodiment, the flows from the respective holes 6*a*, 6*a*-1 and 6*a*-2 can circulate nearly fully along the circumference of the inner wall of the downstream chamber 8, respectively, and thus the flow thus formed by three layers can form the strong swirl in the downstream chamber 8.

By arranging the holes 6*a*, 6*a*-1 and 6*a*-2 at the different levels, the interference of the flows from the respective holes 6*a*, 6*a*-1 and 6*a*-2 can be suppressed, resulting in the higher swirling force.

Figure 11:
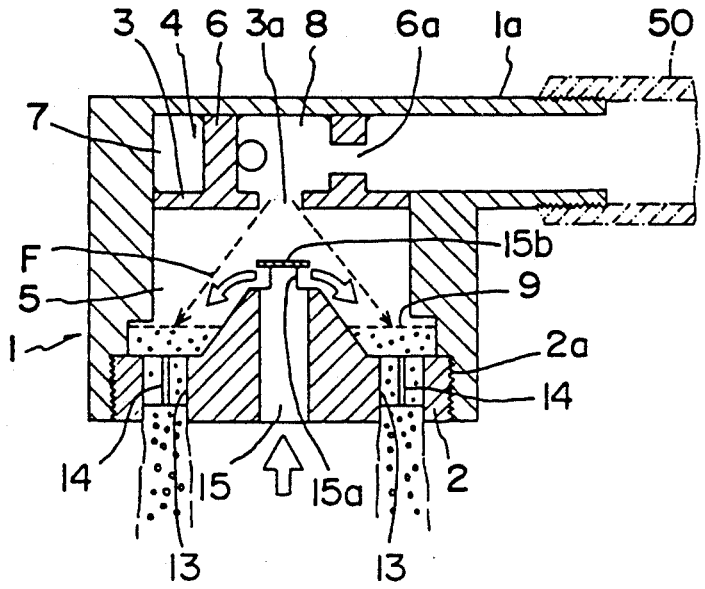
FIG. 11 is a longitudinally sectional view of a major part of another embodiment of a bubbly water outlet device in which an air suction structure is modified.

FIG. 11 illustrates another embodiment of a structure for sucking the air. In the figure, parts and members the same as those in FIG. 1 bear same reference numbers and will not be described in detail below.

In FIG. 11, the distributor plate 2 is attached to the lower end of the outlet head 1 by the thread 2*a*engagement, and has L substantially conical or tapered shape at a central portion thereof. The plate 2 is provided at a periphery with an annularly arranged distributor holes 13, in which baffle plates 14 are arranged, respectively.

Further, an air hole 15 is formed vertically through the center of the distributor plate 2. The upper end of the air hole 15 is connected to an air intake hole 15*a*, which opens laterally and is covered by a shade-like cover 15*b* arranged thereabove for preventing ingress of the water.

When the water is supplied through the spout 50, the pressure outside the conical water film F is reduced, as is done in the aforementioned embodiments, and thus the pressure in the space inside the water film F is reduced, so that the air flows through the intake hole 15*a* at the upper end of the air hole 15, and is mixed into the flowing water, and thus the bubbly water is produced.

The air hole 15 is projected deeply into the bubbler chamber 5, and the intake hole 15*a* at the upper end thereof is located at a level which is high with respect to the discharge end. The water discharged from the discharging port 3*a* forms the conical water film F, so that it does not directly flow into the intake hole 15*a*. Therefore, even if the flow rate is high, the air is stably supplied thereto from the air hole 15, so that the bubbling operation of the water can be maintained and the water will not overflow into the air hole 15.

Since the lower end of the air hole 15 opens at the lower surface of the outlet head 1, the air holes 15 is not visible when used as an ordinary faucet. Therefore, in comparison with conventional structures provided with slit-like openings at side surfaces of outlet heads, dusk or the like will be hardly stuck to the air hole, and thus the opening degree of the the air hole 15 will not be reduced. Thus, an intended flow rate can always be maintained and the bubbling of the water flow can be always achieved sufficiently.

Figure 12:
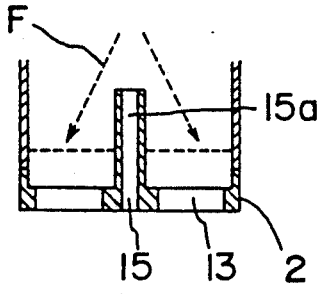
FIG. 12 is a longitudinally sectional view schematically illustrating another embodiment of an air hole structure.

FIG. 12 is a schematic sectional view of another embodiment of a structure of an air hole 15. The air hole 15 is defined by a cylindrical portion projected upwardly into the bubbler chamber 5, and has an open upper end. Although the air hole 15 has the uncovered upper end, the water does not directly flow into the air hole 15 because the water film F is formed by the swirl chamber 4.

Figure 13:
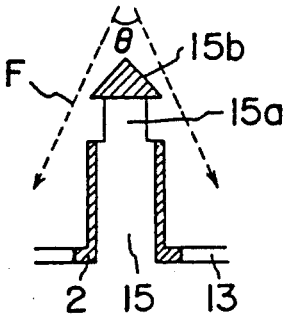
FIG. 13 is a longitudinally sectional view schematically illustrating an air hole having a tapered end.

FIG. 13 illustrates an embodiment in which a cover 15*b* provided at an upper end of the air hole 15 is conically shaped, taking such a case into consideration that a central angle F of the flow of the conical water film F is relatively small. The conical cover 15*b* can reduce a resistance to the flow of the water film F, and thus can maintain a high flow velocity, so that the air is effectively sucked, and the water can be sufficiently bubbled.

Figure 14:
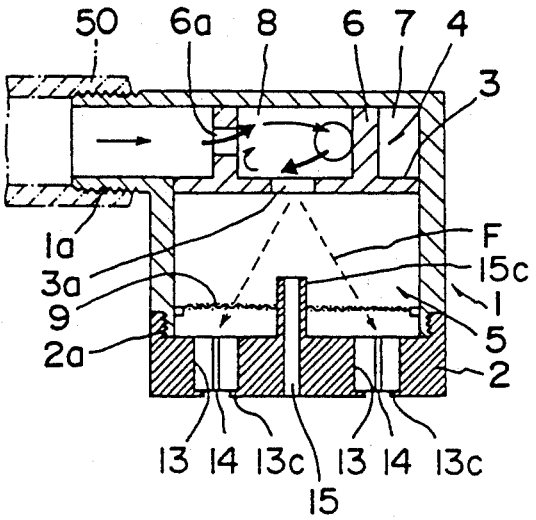
FIG. 14 is a longitudinally sectional view of a major part of another embodiment of a bubbly water outlet device provided with a flow straightening mechanism.
Figure 15:
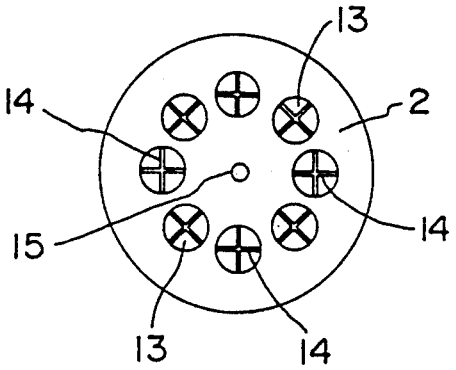
FIG. 15 is a bottom view.

FIG. 14 is a sectional view of an embodiment, which includes the air suction structure shown in FIG. 12 as well as a straightening mechanism in which the baffle plates 14 are assembled in the distributor holes 13. FIG. 15 is a bottom view thereof.

Referring to the Figures, the distributor plate 2 has a thickness larger than that of the conventional distributor plate, and is provided with an annularly arranged eight distributor holes 13. These distributor holes 13 have axes or center lines parallel to the axis of the distributor plate 2, and have same diameters and opening areas. The air hole 15 for sucking the air is provided at the center of the plate 2. This air hole 15 ia extended by a sleeve 15*c* extending axially upwardly from the upper surface of the distributor plate 2 toward the discharge port 3*a*, and thus an intake point of the air is set at a level higher than the net 9.

In each distributor hole 13, there is assembled a straightening mechanism for straightening the bubbly water formed in the bubbler chamber 5 prior to the discharging thereof. The straightening mechanism includes the baffle plate 14 already described. Each baffle plate 14 has a cross-shaped cross section, and is concentrically assembled in the distributor hole 13 as shown in FIG. 15.

Figure 16A:
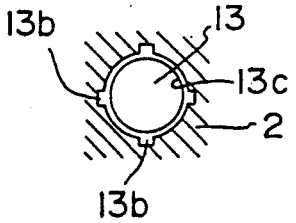
FIGS. 16(*a*) and 16(*b*) are schematic views illustrating a structure for assembling baffle plates.
Figure 16B:
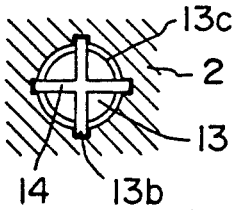

FIG. 16 is a schematic cross sectional view illustrating a structure for assembling the baffle plate 14. As shown in FIG. 16(*a*), each distributor hole 13 is provided at the peripheral wall with axially extending engagement grooves 13*b*, which are complementary to the cross-shaped section of the baffle plate 14, and is provided at the lower end with a holder rib 13*c* having a reduced diameter. In an assembling operation, each baffle plate 14 is inserted into the distributor hole 13 from the above to engage four edges thereof with the engagement grooves 13*b*, respectively, as shown in FIG. 13(*b*), and the plate 14 rests on the holder rib 13*c*, whereby the baffle plate 14 is fixed in the distributor hole 13. The baffle plate 14 thus assembled in the distributor hole 13 divides the distributor hole 13 into four passages, whereby the flow of bubbly water from the bubbler chamber 5 is divided into flows and straightened immediately before the discharging.

Although the baffle plates 14 having the cross-shaped sections are used as the straightening mechanisms assembled in the distributor holes 13 in the illustrated embodiment, any other structures which can subdivide the passages may of course be employed.

Figure 17:
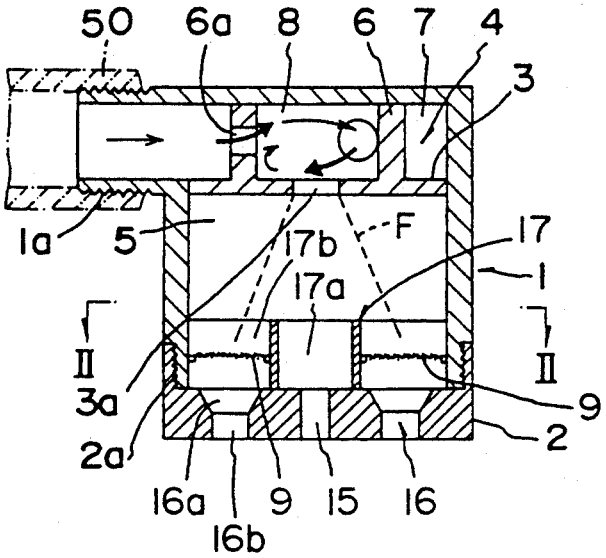
FIG. 17 is a longitudinally sectional view of a major part of another embodiment of a bubbly water outlet device capable of discharging water without vanishing bubbles in bubbly water.
Figure 18:
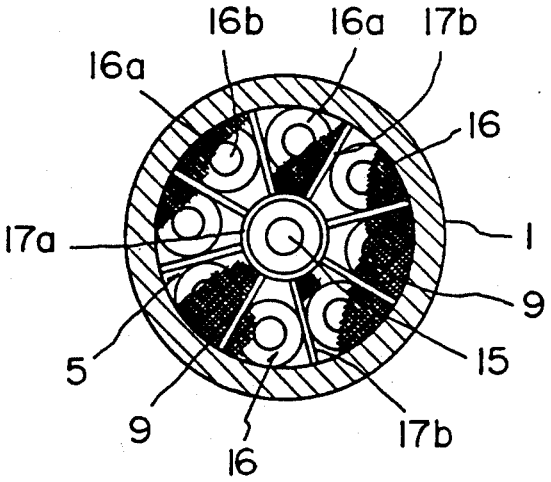
FIG. 18 is a sectional view taken along lines II—II in FIG. 17.

FIG. 17 illustrates an embodiment in which the bubbles in the water to be discharged do not vanish by the compression. FIG. 18 is a sectional view taken along lines II—II in FIG. 17.

The structures for swirling and bubbling the water in the outlet head 1 are substantially the same as those shown in FIGS. 11 and others, and the same members and parts bear the same reference numbers. A section of the structures including the axes of the holes 6*a* is the same as that in FIG. 2.

In the Figures the distributor plate 2 has a thickness larger than that of ordinary shower heads or the like, and is provided, as shown in FIG. 18, with eight annularly arranged distributor holes 16 as well as a central air hole 15. Each distributor hole 16 includes a tapered hole 16*a* at the upstream side which diverges toward the bubbling chamber 5, and a discharge hole 16*b* at the downstream side which continues to the hole 16*a* and has an uniform diameter.

Further, the distributor plate 2 is provided at the upper surface with a fixed guide 17 for introducing the bubbly water into the respective distributor holes 16 and rapidly mixing the sucked air into the water. This guide 17 is composed of an upwardly extending cylindrical sleeve 17*a* coaxial with the air hole 15 and radially disposed partitions 17*b* around the sleeve 17*a*. As shown in FIG. 18, the partitions 17*b* are eight in number and are arranged alternately with the distributor holes 16 so as to prevent the interference of the flows of the bubbly water flowing toward the respective distributor holes 16. A net similar to that in FIG. 14 is arranged in spaces between the partitions 17*b*.

The water supplied from the spout 50 flows downwardly from the discharge port 3*a*, and forms the conical water film F as indicated by a dashed line and already described with reference to FIGS. 11 and 14. The air from the air hole 15 is mixed into the water to bubble it, while the water is flowing into the spaces between the partitions 17*b* of the guide 17 arranged at the lower end of the bubbler chamber 5. The bubbly water flows between the partitions 17*b* of the guide 17 toward the distributor holes 16 and is discharged therefrom. Since, the bubbly water flows between the partitions 17*b* toward the distributor holes 16, as described above, turbulence can be suppressed even when the bubbly water overflows at an area above the distributor plate 2, as is done in the conventional structures. That is; since the passages divided by the partitions 17*b* are formed for the flows toward the respective distributor holes 16, the partitions 17*b* prevent or suppress the interference of the flows toward the distributor holes 16. Therefore, the bubbly water does not intensely and randomly flow along the whole surface of the distributor plate 2, owing to the straightening effect by the partitions 17*b*, and thus the bubbly water can be rapidly discharged. Therefore, the bubbly water can be rapidly discharged before the bubbles vanish, and thus the highly bubbled water flow can be produced.

The bubbly water guided by the partitions 17*b* flows through the tapered holes 16*a* of the distributor holes 16, and is discharged from the discharge holes 16*b* having the uniform sections. Generally, relatively less viscous liquid such as cold and hot water will flow in such a manner that a stream line thereof is curved along the passage wall without causing a separation, even if the pipe passage is rapidly enlarged or contracted. However, since the bubbly water forms a gas-liquid two-phase flow, it has a large compressibility and exhibits a behavior slightly different from that of the ordinary liquid. For example, a portion in the flow having a high density flows more rapidly than another portion due to the weight, so that bubbles are left. This phenomenon will become remarkable in passages having rapidly contracted portions.

In the embodiment, the sections of the passage however are not changed rapidly because the distributor holes 16 include the tapered holes 16*a* and the cylindrical discharge holes 16*b* extending therefrom. Therefore, the bubbly water is not affected by the reduction of the flow passage area, and thus flows through the taper holes 16*a* into the discharge holes 16*b* without causing separation of the bubbles and the liquid. Accordingly, the bubbles are not compressed to vanish, owing to the slow reduction of the passage area, and thus the appropriately bubbled flow can be discharged.

FIGS. 19-22 illustrate a preferred embodiment of the outlet device which has a high washing efficiency owing to a fact that the discharged water itself has a swirling energy.

Figure 19:
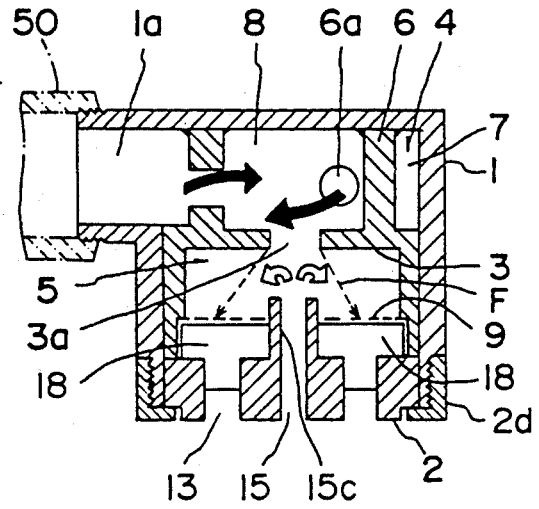
FIG. 19 is a longitudinally sectional view of a major part of another embodiment of a bubbly water outlet device in which a discharged water flow is also swirled.
Figure 20:
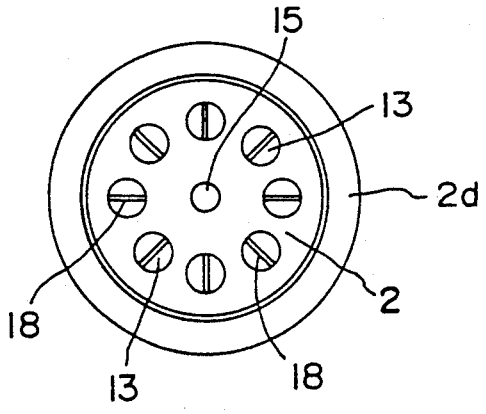
FIG. 20 is a bottom view.

Referring to FIGS. 19 and 20, the outlet hole 1 has structures for swirling and bubbling the water, which are same those in the embodiment described above.

The distributor plate 2 is inserted into the lower end of the outlet head 1 and is supported thereto by a holder piece 2*d* thread-jointed to the outlet head 1. The upper and lower surfaces of the peripheral edge of the distributor plate 2 are restrained slidably by the partition 3 and the holder piece 2*d*. Thus, the distributor plate 2 is coaxially inserted into the outlet head 1, and is rotatable around the axis thereof.

The distributor plate 2 is provided with annularly spaced eight distributor holes 13, as shown in FIG. 20, and a central air hole 15. The air hole 15 is extended by an intake sleeve 15*c* extending from the upper surface of the distributor plate 2 toward the discharge port 3*a* and having an opening at a level higher than the net 9. Around the intake sleeve 15*c*, vanes 18 are provided for rotating the distributor plate 2 by the supplied water flow.

Figure 21:
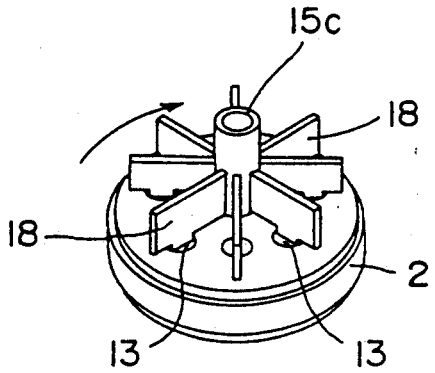
FIG. 21 is a perspective view of a distributor plate viewed from the above.
Figure 22:
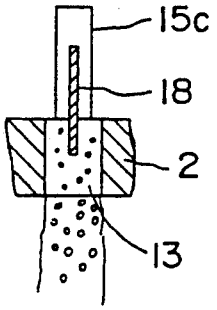
FIG. 22 is a longitudinally sectional view of a major part for illustrating an arrangement of vanes.

FIG. 21 is a perspective view of the distributor plate viewed from the above, and FIG. 22 is a sectional view illustrating a section including axes of the distributor holes 13 and viewed in a direction of the intake sleeve 15*c*.

As shown therein, the vanes 18 are eight in number, and are radially disposed around the intake sleeve 15*c* on planes passing the centers of the distributor holes 13, respectively, as shown in FIG. 22. The lower end of each vane 18 is located in a middle portion of the distributor hole 13 to divide an upper half of the distributor hole 13 into two passages.

In these structures, the water discharged from the discharge port 3*a* is bubbled by the air mixed therewith in the bubbler chamber 5, and then is discharged in the form of the showering flow from the distributor holes 13. In this operation, the water from the discharge port 3*a* is discharged in the form of the water film F formed by the continuous swirl in the swirl chamber 4, so that an energy remains as the swirling flow in the water film. Therefore, the swirling action of the water film F and the centrifugal force of the flow itself act on the vanes 18 to rotate the distributor plate 2 in a direction indicated by an arrow in FIG. 21. Accordingly, the distributor holes 13 are not fixed and is continuously displaced during the charging operation, and the water is discharged from the rotating distributor holes 13.

As described above, the supplied water can be fed into the bubbler chamber 5 after forming the swirling flow, and the distributor plate 2 can be rotated by using the centrifugal force remaining in the flow itself after bubbling thereof. Therefore, the discharging points of the water from the distributor plate 2 continuously moves, and thus the discharging points in the respective distributor holes 13 continuously changes. Accordingly, as compared with the discharging from the fixed distributor holes 13, the bubbly water is stirred, resulting in a comfortable stimulus when used as a shower head.

Since the discharged water is bubbled, disadvantageous splash can be prevented, so that the device can be utilized not only as shower baths but also as faucets for sinks and wash stands. Since the rotation of the distributor holes 13 adds the swirl energy to the discharged water itself, it has a high washing ability and can be comfortably used.

Figure 23:
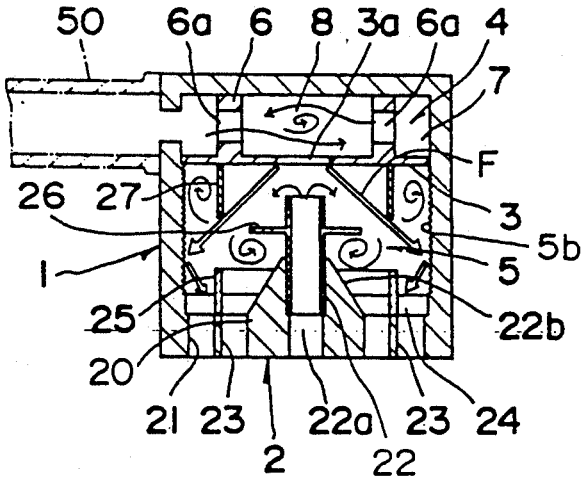
FIG. 23 is a longitudinally sectional view of a major part of another embodiment of a bubbly water outlet device in which reverse flow of bubbly water and pulsation therein are prevented.

FIG. 23 is a longitudinally sectional view of an embodiment, which is adapted to prevent a reverse flow of the bubbly water and pulsation of the supplied water. This embodiment is based on the structures in FIG. 17, and same members bear same reference numbers and will not be described in detail hereinafter.

Figure 24A:
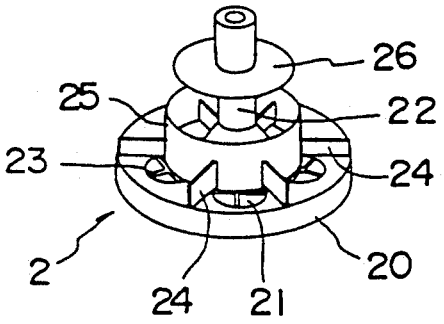
FIG. 24(*a*) is a perspective view of a distributor plate.
Figure 24B:
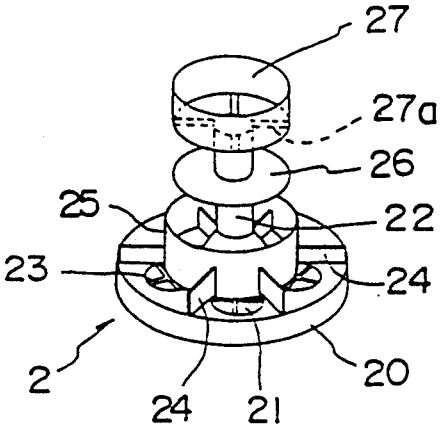
Figure 25:
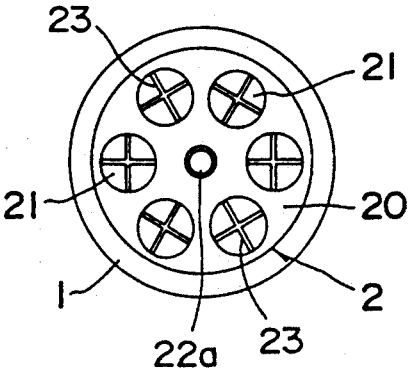
FIG. 25 is a bottom view of an outlet head.

The distributor plate 2 provided at the lower end of the outlet head 1 includes an air suction structure for straightening and discharging the bubbly water as well as for bubbling the water, and the whole structure is illustrated in a perspective view of FIG. 24(*a*). The distributor plate 2 is provided ar the end with a base 20 which is fixed by a thread engagement to the discharge end of the outlet head 1, and six distributor holes 21 are provided in this base 20 (see FIG. 25). An upwardly protruded air suction pipe 22 is coaxially arranged in the center of the base 20, and an air passage 22*a* is formed therein.

The base 20 is designed as shown in FIG. 23, so that the distributor holes 21 have axial lengths extended to some extent for straightening the bubbly water flowing therethrough. A cross-shaped baffle plate 23 is assembled in each distributor hole 21 so that a turbulence of the bubbly water flowing through the distributor hole 21 may be prevented. Six baffle vanes 24 extending from the air suction pipe 22 are arranged on the upper surface of the base 20, as shown in the Figure. These baffle vanes 24 extend between the adjacent distributor holes 21 to the edge of the base 20, and has a thickness which is about half of the axial length of the distributor hole 21. Further, a circular and annular baffle plate 25 passing through the centers of the distributor holes 21 are coaxially arranged on the upper surface of the base 20. This annular baffle plate 25 extends, as shown in FIG. 23, along the centers of the cross-shaped baffle plates 23 arranged in the distributor holes 21, and has a height which is about double the height of the baffle plate 23.

The air suction pipe 22 has an outer conical surface 22*b*, which projects upwardly from the upper surface of the base 20, and is of a truncated conical shape converging upwardly. This conical surface 22*b* is used as a guide for the bubbly water. Further, a cylindrical portion having an uniform diameter is projected from an upper end of the conical surface 22*b*, and an upper end thereof is faced to the discharge port 3*a* of the swirl chamber 4. A nonreturn plate 26 is arranged around an upper portion of the air suction pipe 22. This nonreturn plate 26 is formed by a horizontal circular plate and has an outer diameter substantially equal to or smaller than that of the annular baffle plate 25. Further, as shown in FIG. 23, an annular nonreturn plate 27 is coaxially fixed to the lower surface of the partition 3, and is arranged coaxially with the bubbler chamber 5. This nonreturn plate 27 has an inner diameter which is substantially larger than or equal to that of the lower nonreturn plate 26 and is nearly same as that of the annular baffle plate 25.

Figure 26:
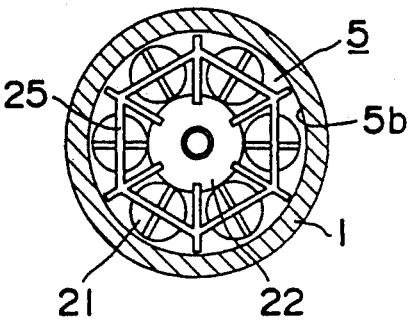
FIG. 26 is a cross sectional view of an outlet head illustrating another structure of a baffle plate.

The annular nonreturn plate 27 may be fixed, not to the partition 3, but to the distributor plate 2 as shown in FIG. 24(*b*). In this case, the nonreturn plate 27 is rigidly connected to the upper end of the air suction pipe 22 by means of four stays 27*a*, so that it may not prevent or hinder the flows of the water and air. The annular baffle plate 25 arranged on the upper surface of the base 20 may be of hexagon shape having corners located between the distributor holes, respectively as shown in FIG. 26.

An internal thread 5*b* is formed on the inner peripheral wall of the bubbler chamber 5 to form an interference surface. When the water in the form of the film flowing from the discharge port 3*a* collides with the thread 5*b*, the pulsation which the flow may have is damped by the interference. Instead of the internal thread 5*b*, which is preferably employed because it requires a simple work, the interference surface may be formed of other fine unevenness provided at the inner peripheral wall of the bubbler chamber 5.

The water supplied from the spout 50 is discharged in the form of the water film F from the discharge port 3*a*, and collides with the internal thread 5*b* in the bubbler chamber 5, resulting in splashed or dispersed water flow to which the air is sufficiently mixed, and thus the water is bubbled. The water thus bubbled flows into the distributor holes 21 and is straightened by the baffle plates 23 before being discharged.

In the above operation, the nonreturn plates 26 and 27 arranged in the upper portion of the bubbler chamber 5 do not form barriers against the conical water film F from the discharge port 3*a* and the air sucked from the upper end of the air suction pipe 22, and allow rapid passing of the water and air. The bubbly water, which is produced by the collision of the water film F against the internal thread 5*b* and the mixing with the air, is prevented from reversely flowing toward the discharge port 3*a* and the upper end of the air suction pipe 22, because the nonreturn plates 26 and 27 function as barriers. Therefore, the upper end of the air suction pipe 22 is not poured with the bubbly water or the water flowing from the discharge port 3*a*, and thus the air can be smoothly and rapidly sucked. Accordingly, a sufficient amount of air is sucked, so that the bubbling is promoted, and the air suction noise and water flowing noise can be reduced because the water is suppressed from directly mixing with the inflow air.

The water film F collides with the internal thread 5*b* of the bubbler chamber 5, and the unevenness of the surface interferes with the pulsation or the like in the flow and damps it. Thus, the supplied water is forced to swirl in the swirl chamber 4, which increases the flowing energy, and then flows in the form of the water film F from the discharge port 3*a*. Therefore, as compared with general flows in pipes, pressure fluctuation or the like is liable to be caused due to the pulsation, inertia or the like of the flow itself. However, since the fine unevenness such as the internal thread 5*b* is provided so as to reflect the flows in various directions, the pulsing energy may be interfered, resulting in the stable flow. Accordingly, the bubbly water containing the air does not form interrupted flows or does not fluctuate, so that the stable discharging at a constant flow rate can be achieved.

Further, the conical surface 22*b* of the air suction pipe 22 gently guides and introduces the bubbly water into the distributor holes 21, so that the gas-liquid two-phase flow containing the bubbles can be discharged without cavitation or separation from the passage wall. Therefore, the noise of the discharged water can be reduced, and surroundings are not adversely affected even at a high flow rate. If the flow rate is low, the bubbly water is discharged without entirely filling the bubbler chamber 5. In this case, the flow velocity of the bubbly water decreases, and the stream lines may be disturbed. However, the bubbly water rapidly flows along the conical surface 22*b* to the respective distributor holes 21. Therefore, even at a low flow rate, the bubbly water is positively guided and is prevented from stagnating in the bubbler chamber 5, so that the water is uniformly fed to the respective distributor holes 21, which prevents deformation of the form of the discharged water flow.

The bubbly water thus stably flowed is reflected by the internal thread 5*b* toward the respective distributor holes 21, as indicated by the arrow in FIG. 23, and this behavior becomes more remarkable as the flow rate increases. In this operation, the annular baffle plate 25 on the base 20 prevents the concentration of the bubbly water toward the center. That is; since the annular baffle plate 25 preventing the flowing of the water toward the center, the bubbly water is not concentrated into the radially inner portions of the distributor holes 21, and is uniformly discharged through the whole regions of the respective distributor holes 21.

The bubbly water, which is uniformly distributed in the radial direction without concentrating toward the center, is discharged further stably owing to the baffle vanes 24 which divide the spaces between the respective distributor holes 21 That is; the radially arranged baffle vanes 24 function to reduce the swirling force of the water generated in the swirl chamber 4 and to prevent the interference of the flows toward the respective distributor holes 21. This reduction of the swirling force contributes to dynamically stabilize the water flows, and also to prevent the influence from the exterior against the bubbly water flow itself divided by the baffle vanes 24 before being discharged.

Immediately before the discharging, the flow of the bubbly water is straighten by the cross-shaped baffle plates 23 as it passes through the distributor holes 21.

Each baffle plate 23 divides the passage in the distributor hole 21 into four portions, so that the flow of the bubble water fed into the hole 21 is subdivided by the baffle plate 23 into straightened parallel flows, and the discharged flow neither diverges nor converges.

As described above, the fed water is swirled and is supplied into the bubbler chamber 5 in the form of the conical water film F, and then the air is mixed therewith to produce the bubbly water, so that the pressure loss is remarkably reduced, as compared with the conventional structures employing pressure reducing plates. Further, even at a low flow rate, the water is sufficiently bubbled, and is stabilized by the annular baffle plate 25 and baffle vanes 24 before flowing along and for the baffle plates 23, so that the bubbly water flow without turbulence can be appropriately produced.

It has been confirmed that if the air passage 22*a* in the air suction pipe 22 has a section of 3.5 mm in diameter, and the upper end of the air suction pipe 22 and the lower surface of the partition 3 are spaced by a distance of about 6 mm, the noises are sufficiently reduced and the flow rate of the suction air is sufficiently increased at a supply pressure for home use. Accordingly, of setting the sizes and relationship described above, devices which are silent and can sufficiently perform the bubbling can ne produced.

Figure 27:
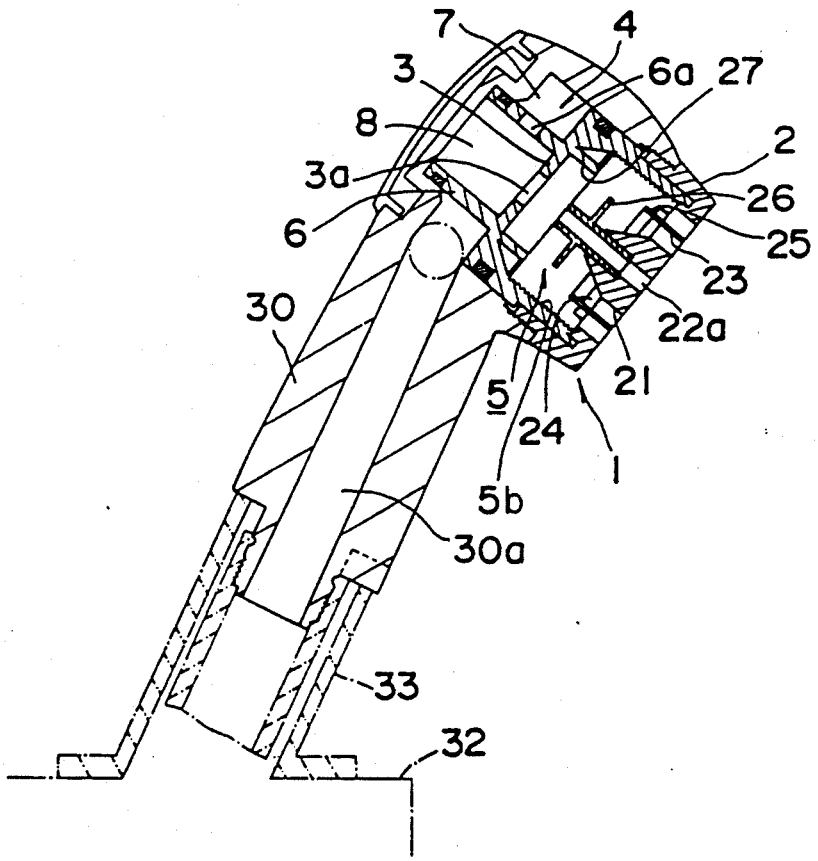
FIG. 27 is a longitudinally sectional view of a major part of another embodiment of a bubbly water outlet device in which an outlet head s assembled in a shower head body.

FIG. 27 is a sectional view of a major part of another embodiment, in which the structures in FIG. 23 is employed in a faucet of a shower head type. Same members as those in FIGS. 23–26 bear same reference numbers.

The outlet head 1 is integrated with a shower head body 30 so as to use it as a hand shower head, and is connected to a passage 30*a* formed in the body 30. The shower head body 30 is detachably supported by a holder 33 fixed on a counter on a cabinet, and is adapted to connect with a hose (not shown) for supplying the water to it from a combination faucet or from an electrical hot water supplier. The holder 33 is so constructed that the shower head body 30 and the hose can be detached or pulled out therefrom and the body 30 can be held with a hand to wash vessels or the like. Conventionally, there have been used such detachable hand shower heads provided with hoses.

The upstream chamber 7 is annularly formed when assembled in the shower head body 30, and an annular nonreturn plate 27 is fixedly formed on the partition 3. Other structures are similar to those in FIG. 25.

The bubbly water from the shower head body 30 provided with the outlet head 1 is discharged as a stable showering flow which is not disturbed after the bubbles are formed, as described previously.

Figure 28A:
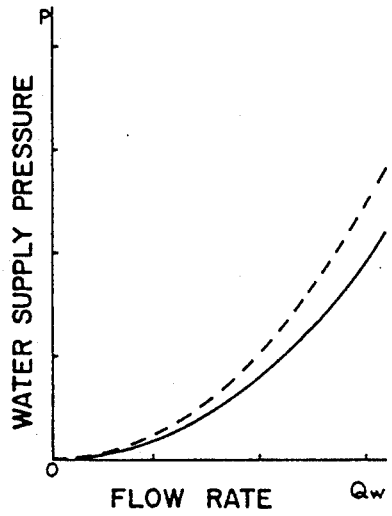
FIGS. 28(*a*), 28(*b*) and 28(*c*) are graphs illustrating comparative characteristics of a bubbly water outlet device of FIG. 23 and conventional structures.
Figure 28B:
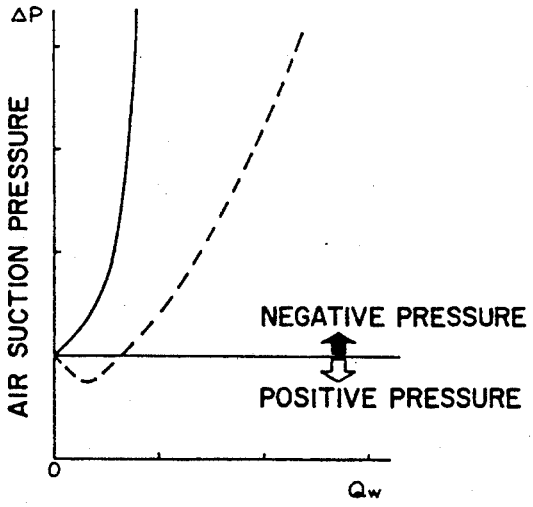
Figure 28C:
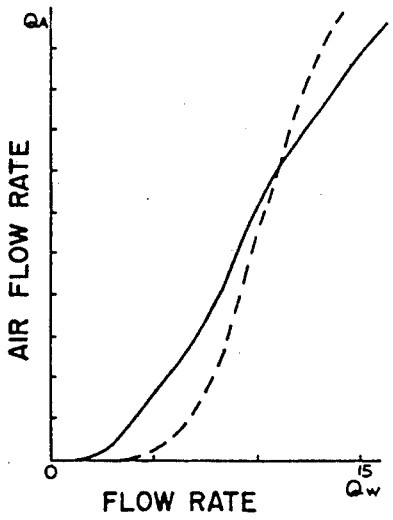

FIG. 28 is qualitative graph comparing the characteristics of the embodiment and the conventional structures, in which a solid line indicates the characteristics of the structure in FIG. 23 and a dashed line indicates those of the conventional structures.

In FIG. 28(*a*), an abscissas indicates a flow rate of the supplied water, an ordinate indicates a pressure drop in the flow passage, and thus the pressure loss is illustrated. As shown therein, the pressure loss is reduced in comparison with the conventional structures. The reduction of the pressure loss contributes to maintain the velocity of the water flow into the bubbler chamber 5, so that as shown in FIG. 28(*b*), the pressure drop is also increased with respect to that in the conventional structures. The pressure rapidly drops from an region at a low flow rate, so that the mixing of the air is promoted even at the low flow rate, resulting in the appropriate bubbling operation. FIG. 28(*c*) illustrates a relationship with respect to the amount to the sucked air, and as shown therein, the amount of the sucked air is increased in accordance with the increasing of the pressure drop, as compared with the conventional structures.

As described above, in addition to the reduction of the pressure loss, the mixing of the air is rapidly effected, so that the sufficiently bubbled water can be discharged even at a low flow rate, which has been impossible in the conventional structures.

Figure 29:
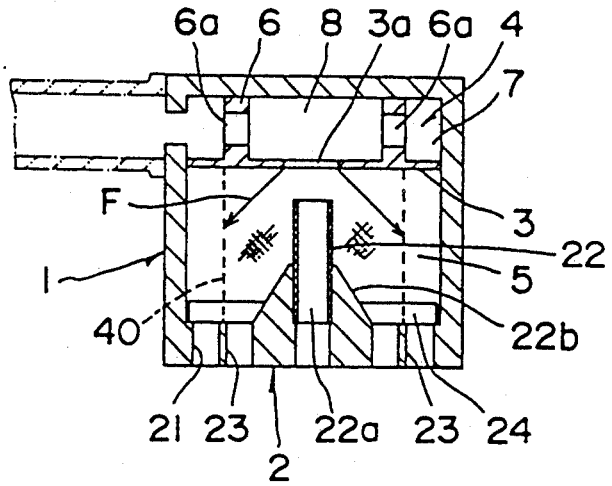
FIG. 29 is a longitudinally sectional view of a major part of another embodiment of a bubbly water outlet device which includes a cylindrical net for preventing a reverse flow and for straightening a flow.
Figure 30:
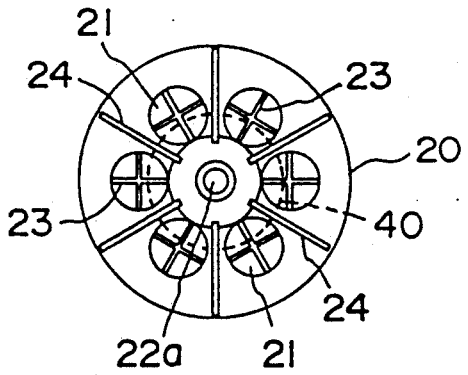
FIG. 30 is a bottom view of a distributor plate.
Figure 31:
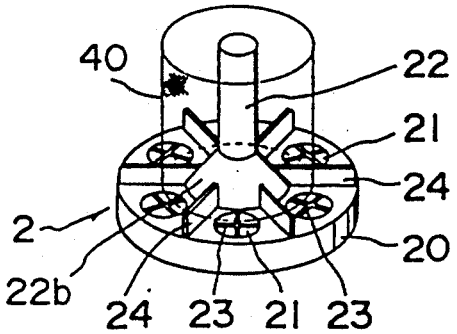
FIG. 31 is a perspective view of a distributor plate viewed from the above.

FIGS. 29–31 illustrate an embodiment, which is based on the structures in FIG. 23 and is additionally provided with a cylindrical net for preventing a reverse flow and for a straightening effect.

The distributor plate 2 is provided with, instead of the annular baffle plate 25 in FIGS. 23 and 24, a cylindrical net 40 concentrical with the base 20. This cylindrical net 40 has fine meshes, of which wire diameter is of about 0.3 mm and a mesh (opening) size is about 0.5 mm. A diameter of the cylindrical net 40 may be smaller than that of a circle passing through the centers of the distributor holes 21, as shown in FIG. 30, or may be equal to a circle passing through the centers of the cross-shaped baffle plates 23, as shown in FIG. 29. When assembled in the outlet head 1, as shown in FIG. 29, the cylindrical net 40 is in contact at the upper end with the lower surface of the partition 3, and divides the bubbler chamber 5 into two subchambers.

The water supplied from the spout 50 is discharged in the form of the conical water film F from the discharge port 3*a*, as indicated by arrows in FIG. 29. Meanwhile, the discharge port 3*a* is located substantially at the center of the bubbler chamber 5, and the water having the centrifugal force is discharged at a high velocity, so that the pressure at the space inside the conical water film F is reduced. Therefore, the air is sucked through the air passage 22*a*, and is mixed with the water which is dispersed by the collision of the water film F from the discharge port 3*a* with the cylindrical net 40 in the bubbler chamber 5, and thus the water is bubbled. The bubbly water flows into the distributor holes 21 and is discharged after being straightened by the baffles plates 23.

In the aforementioned flows, the water flowed into the bubbler chamber 5 is bubbled by the air which mixed therewith when the water passes through the cylindrical net 40 to the outside thereof. Therefore, the water from the discharge port 3*a* is bubbled after it rapidly passes through the meshes of the cylindrical net 40 and the bubbly water containing the air is interrupted by the meshes and thus is prevented from reversely flowing toward the air suction pipe 22. Thus, the bubbly water and the water discharged from the port 3*a* will not substantially pour onto the upper end of the air suction pipe 22, which allow sufficient suction of the air. Accordingly, the amount of the sucked air is ensured to be enough to promote the bubbling operation, and also the degree in which the water is directly mixed with the inflow air is reduced so that the air suction noises and water noises can be reduced.

Since the water film F passes through the fine meshes of the cylindrical net 40, the flow is finely dispersed, so that the pulsation and others are interfered and damped. Thus, the water is forcedly swirled in the swirl chamber 4 producing the high flowing energy, and then is discharged from the discharge port 3*a* in the form of the water film F. Therefore, as compared with general pipe flows, pressure fluctuation may be generated due to the pulsation and inertia of the flow itself. With respect to this, the fine meshes of the cylindrical net 40 stir the flow to effect the interference of the wave energy and thus can stabilize the flow. Accordingly, the bubbly water containing the air will not become an intermittent flow or unstable flow, and thus the stable discharging at a constant flow rate can be ensured.

Further, the cylindrical net 40 is arranged in such a position that the meshes are spread toward the flowing directions of the water, so that they also serve to straighten the flow of the bubble water before it reaches the distributor hole 21. Thus, in comparison with such a case as that in which the bubbly water is straightened only at a stage immediately before the discharging, the straightening effect by the baffle plates 23 can be further improved, because the flow is straightened to some extent before it reaches the distributor holes 21.

The cylindrical net 40 thus assembled in the bubbler chamber 5 exhibits three functions, i.e., bubbling of the water, preventing of the reverse flowing of the bubbly water and straightening of the bubbly water flow, so that the optimum bubbly water can be generated by relatively simple structures.

As described above, the water is swirled and is supplied in the bubbler chamber 5 in the form of the conical water film F, and then the air is mixed therewith to produce the bubbly water, so that the pressure loss is remarkably reduced, as compared with the conventional structures utilizing the pressure-reducing plates. Therefore, even at a low flow rate, the water can be sufficiently bubbled, and is passed through the baffle plates 23 after it is stabilized by the cylindrical net 40 and the baffle vanes 24, so that the optimum bubbly water can be discharged without turbulence by the very simple structures.

Figure 32:
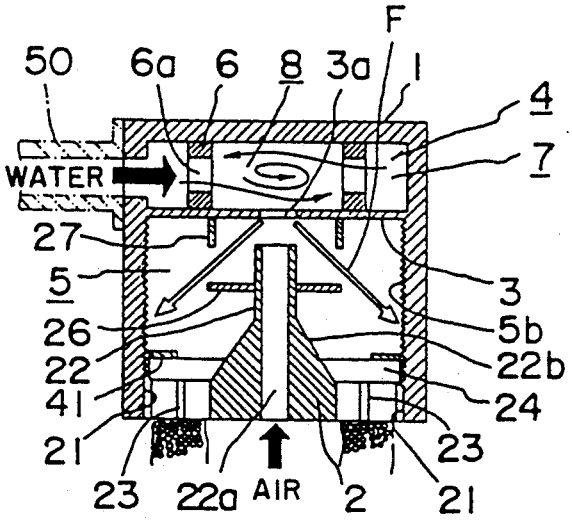
FIG. 32 is a longitudinally sectional view of a major part of another embodiment of a bubbly water outlet device which is intended to suppress pulsation.

FIG. 32 is a longitudinally sectional view of an outlet head 1 of an embodiment, in which the good bubbly water can be discharged without pulsation. This is based on the structures in FIG. 23, and the same members bear the same reference numbers.

Figure 33:
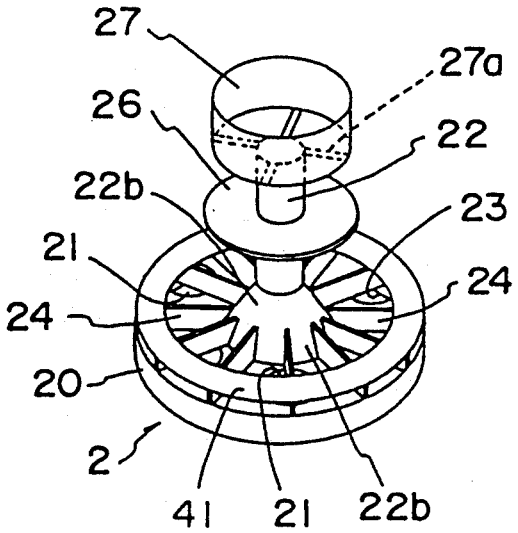
FIG. 33 is a perspective view of a distributor plate viewed from the above.

The distributor plate 2 serves to straighten and discharge the bubble water and includes the air suction structure for bubbling the water, similarly to that in FIG. 23, and the whole structure is illustrated as a perspective view, in FIG. 33.

An annular anti-pulsation plate 41 is attached to the upper edge of the baffle vanes 24 on the base 20 provided at an end of the distributor plate 2. This anti-pulsation plate 41 is located at the radially outer ends of the baffle vanes 24, and is radially projected along the inner wall of the bubbler chamber 5, as shown in FIG. 32, when it is assembled in the outlet head 1. Further, the internal thread **5*b* forming the interference surface is formed on the inner peripheral wall of the bubbler chamber 5. The anti-pulsation plate 41 forms a point which the water film F from the discharge port 3*a* reaches, and the flow stagnates at this point, so that the pulsation can be eliminated. That is, the pulsation flow is one kind of discontinuous flow. Therefore, if the flow is temporality stagnated near the antipulsation plate 41 before flowing downwardly, the water discharged from the distributor holes 21 forms the continuous flow, and the pulsation flow can be perfectly prevented. By employing the anti-pulsation plate 41 and the internal thread 5*b* for interfering the flow, the pulsation, which may be generated by forcedly swirling and bubbling the water, may be eliminated. Therefore, even if the capacity of the passage is small, the pulsation can be prevented, and thus, the outlet head 1** can be compact even if it is assembled with the device for discharging the bubbly water flow as well as the concentrated flow.

Figure 34:
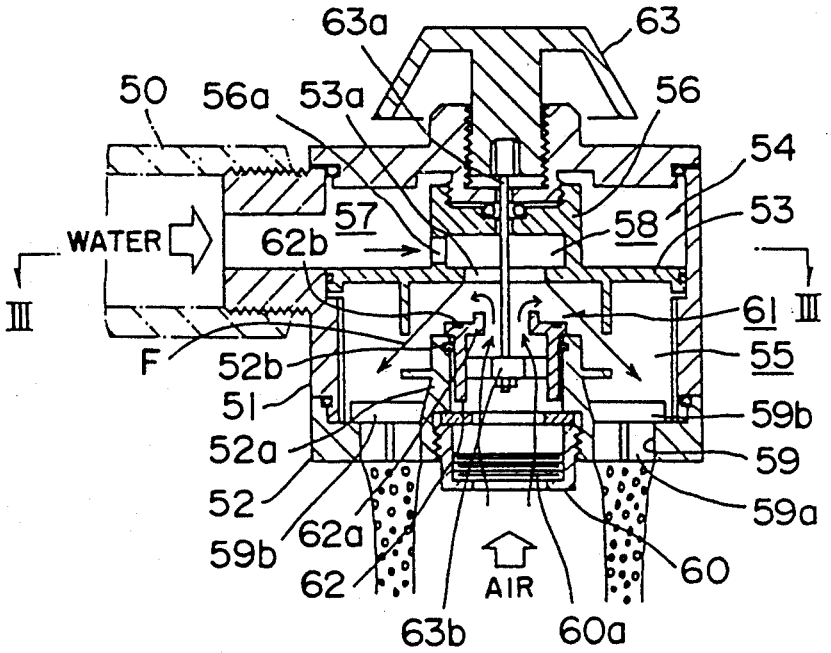
FIG. 34 is a longitudinally sectional view of a major part of another embodiment of a bubbly water outlet device in which a bubbly water flow and an ordinary flow can be selectively discharged.
Figure 35:
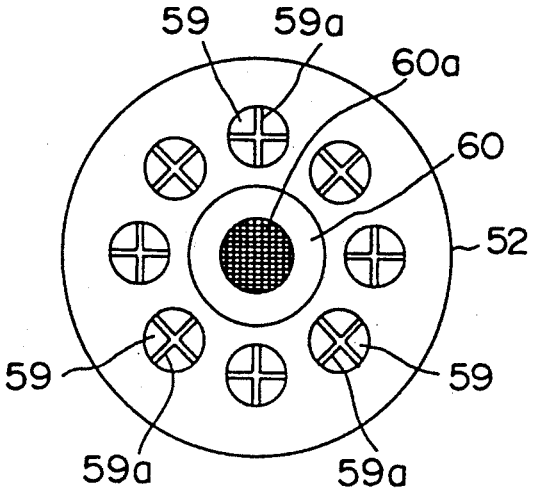
FIG. 35 is a bottom view.
Figure 36:
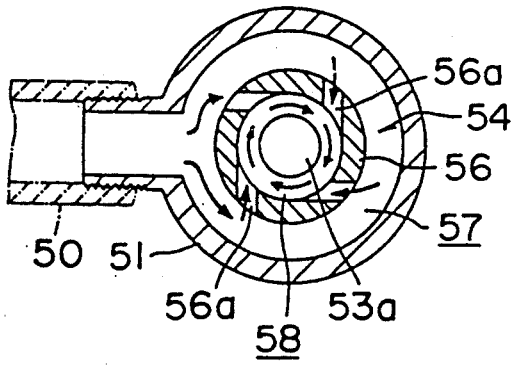
FIG. 36 is a sectional view taken along lines III—III in FIG. 34.

FIG. 34 is a longitudinally sectional view of an outlet device, in which the bubbly water flow and the concentrated flow can be selected. FIG. 35 is a bottom view and FIG. 36 is a schematic cross sectional view taken along lines III—III in FIG. 34.

In the Figures, an outlet head 51 for bubbling the water is attached to the end of the spout 50. The outlet head 51 has structures based on those shown in FIG. 23, and is provided at the lower end with a distributor plate 52. The outlet head 51 is provided at the interior thereof with a partition 51 having a discharge port **53*a*, a swirl chamber 54 and a bubbler chamber 55 as well as an annular wall 56 dividing the interior into an upstream chamber 57 and a downstream chamber 58. The annular wall 56 has four holes 56*a*, as shown in FIG. 36**.

The distributor plate 52 is provided with a plurality of annularly arranged distributor holes 59 for bubbling the water, as shown in FIG. 35, and is also provided at the center thereof with a structure serving as a passage for the discharged water flow and also serving as passage for swirling the air when the bubbling of the water is intended. Cross-shaped baffle plates **59*a* are arranged in the distributor holes 59, respectively, and radially arranged baffle vanes 59*b* which extend on the centers of the distributor holes 59** are disposed on the upper surface of the plate.

A cylindrical sleeve **52*a* is projected from the center of the distributor plate 52 into the bubbler chamber 55. A baffle head 60 forming a passage for a concentrated flow is connected to a lower end of the sleeve 52*a*. The baffle head 60 is a cylindrical member, of which upper and lower ends are open and a baffle net 60*a* is assembled in the head 60. The baffle head 60 forms the aforementioned mechanism serving as the passage for the concentrated flow and serving as the passage for sucking the air when the bubbling of the water is intended, and a selector valve 61 for selection is provided in the sleeve 52*a*. The selector valve 61 includes a cylindrical valve body 62, slidably assembled in the sleeve 52*a*, and the valve body 62 is adapted so as to be vertically moved by an operating handle 63 provided at the end of the outlet head 1 for selecting the bubbly flow and the straight flow. The operating handle 631 includes a spindle 63*a* extending through the swirl chamber 54 and the discharge port 53*a*, and is connected to the valve body 62** through a cross-shaped stays at the lower end thereof.

A flange **62*a* having a diameter larger than an inner diameter of the discharge port 53*a* is formed at the upper end of the valve body 62, and a packing 62*b* is disposed on the upper surface of the flange 62*a*. A packing 52*b* for sealing the peripheral surface of the valve body 62 is attached to the upper end portion of the inner surface of the sleeve 52*a***.

Figure 37:
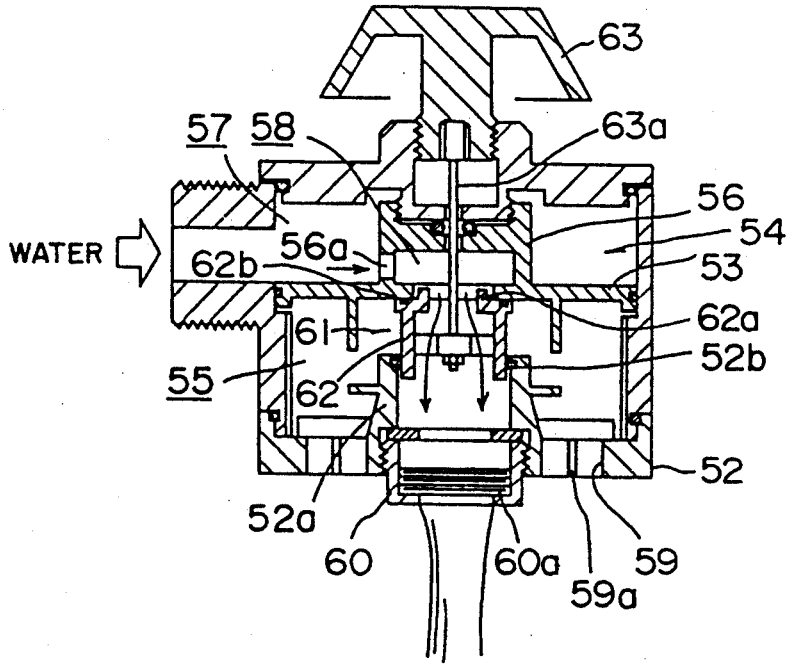
FIG. 37 is a longitudinally sectional view illustrating structures switched to a straight flow discharging condition.

In FIG. 34 the valve body 62 is lowered to the lowermost position, and the discharge port **53*a* is open. When the operating handle 63 is rotated to raise the spindle 63*a*, the flange 62*a* of the valve body 62 comes in contact with the lower surface of the partition 53, as shown in FIG. 37 and the packing 62*b* shuts off a passage between the discharge port 53*a* and the bubbler chamber 55. When the packing 62*b* rests on the lower surface of the partition 53 around the discharge port 53*a*, the lower portion of the valve body 62 is located in the sleeve 52a and the packing 52b shuts off the passage to the baffle head 60 from the bubbler chamber 55. As described above, by raising the valve body 62, the discharge port 53a connects with the bubbler chamber 55 and the baffle head 60 connects the bubbler chamber 55 to the exterior, and the discharge port opens only toward the baffle head 60, in the case shown in FIG. 37. Therefore, in FIG. 34, the bubbly water is discharged from the distributor holes 59 by the swirling, and in FIG. 37, the ordinary concentrated flow is discharged from the baffle head 60**.

When the water is supplied from the spout 50, it is discharged in the form of the conical water film F, and is done in the outlet structures described before and as indicated by an arrow, and the pressure in the space outside the conical water film F decreases. Therefore, in the embodiment in FIG. 34, the air is sucked through the sleeve 52a from the baffle head 60 opening to the exterior and is mixed into the water film F discharged from the discharge port 53a, and thus the water is bubbled. The bubbly water flows into the distributor holes 59, and the flow is straightened by the baffle plates 59a before it is discharged.

As described above, by lowering the valve body 62 into the sleeve 52a to open the discharge port 53a to the bubbler chamber 55, the passage for supplying the concentrated flow into the baffle head 60 is utilized as a suction passage for the air required for the bubbling operation. Contrarily, when the operating handle is turned to close the discharge port 53a by the valve body 62, as shown in FIG. 37, the water from the swirl chamber 54 flows toward the baffle head 60. In the downstream chamber 58, the water swirls and flows through the discharge port 53a, and it does not form the the conical water film shown in FIG. 34, because the passage is restricted and narrowed by the valve body 62, so that the water forms the concentrated flow having stream lines in a bundle and is discharged from the baffle head 60.

Instead of the baffle head, any other head 60 such as a spray shower head which has an open passage connecting the bubbler chamber 55 to the atmosphere may be employed.

In this embodiment, the bubbly water flow and ordinary concentrated water flow can be selected, and the passage for the concentrated water flow can also be used as the suction air passage when the bubbly water flow is selected. Therefore, it is not necessary to provide an air suction passage for the bubbly water flow in addition to the passage for the concentrated flow. Therefore, although the structures have functions for the bubbly water flow and the concentrated water flow, the outlet head can be made compact and thus can be of optimum use for the various applications such as faucets and shower heads.

Figure 38:
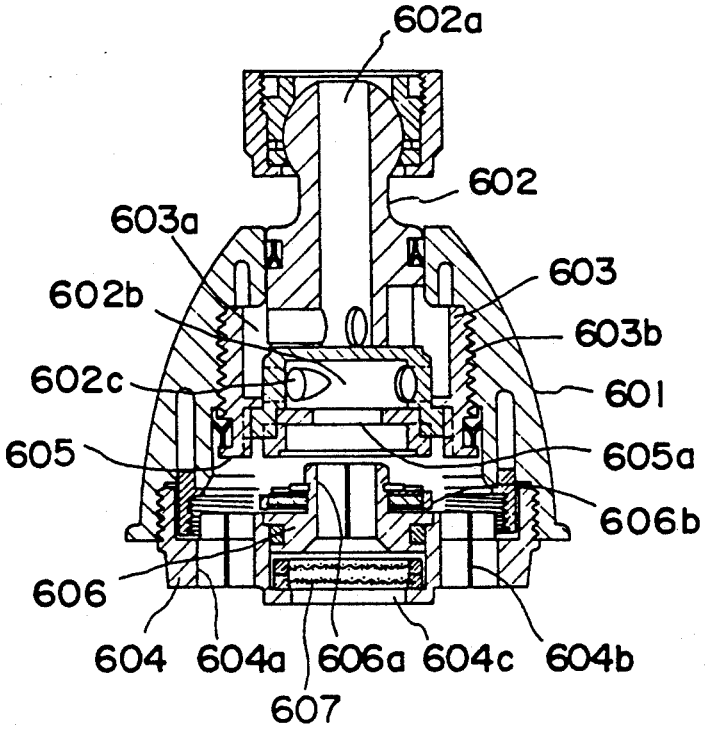
FIG. 38 is a longitudinally sectional view of a major part of another embodiment of a bubbly water outlet device in which outlet structures similar to those in FIG. 34 are assembled in a spray head.
Figure 39:
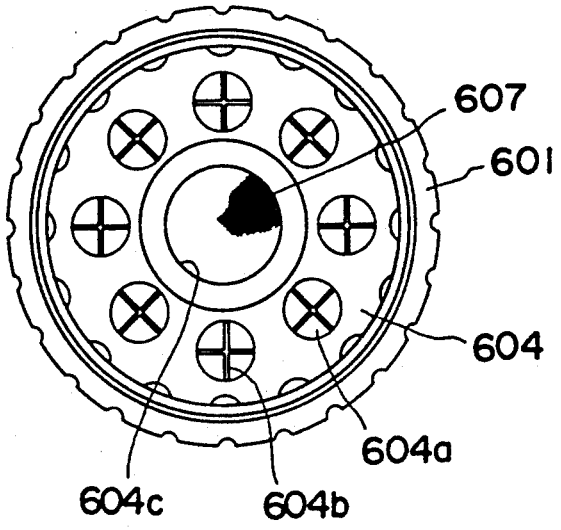
FIG. 39 is a bottom view.

FIG. 38 is an longitudinally sectional view of the embodiment having structures similar to those in FIGS. 34–37, and FIG. 39 is a bottom view thereof.

This embodiment is constructed to be used as a spray head for kitchens. An outlet head includes a main body 601, a connector 602 connected to a water supply source, a connector ring 603 connecting the main body 601 and the connector 602 together and a distributor plate 604 fixed at a lower end of the main body 601.

The connector 602 forms a flow passage 602a connected to the water supply source, and the passage 602a has a terminal end communicating with an internal passage 603a in the connector ring 603. The connector 602 is provided at its lower end with a swirl chamber 602b continuous to the internal passage 603a, and a peripheral wall of the swirl chamber 602b is provided with a plurality of holes 602c in an arrangement similar to that in the aforementioned embodiments. A valve seat ring 605 for selecting the bubbly flow and the straight flow is fixed at a lower end of the connector 602. The valve seat ring 605 forms a bottom wall of the swirl chamber 602b, and is provided at the center thereof with a discharge port 605a connecting to a passage for the distributor plate 604.

The connector ring 603 is fixed to the connector 602 and is connected to the main body 601 so as to allow an axial movement thereof by means of a thread engagement 603b. Thus, by rotating the main body 601, the main body 601 is axially moved with respect to the connector 602 by means of thread engagement 603b.

The distributor plate 604 is provided with a plurality of annularly arranged distributor holes 604a respectively accommodating baffle plates 604b and is provided at its center with a concentrated flow discharge port 604c. A sleeve 606 is connected to this concentrated flow discharge port 604c, and a net 607 for straightening the flow is assembled therein. The sleeve 606 having an upwardly extending cylindrical portion 606a coaxial with the discharge port 605a, and a packing 606b intimately contacting the lower surface of the valve seat ring 605 is disposed therearound.

In the illustrated condition, the main body 601 is located at the lowermost position, in which the valve seat ring 605 is separated from the sleeve 606 and the discharged port 605a is opened toward the distributor plate 604. Thereby, when the water swirled in the swirl chamber 602b is discharged from the discharge port 605a toward the distributor plate 604, the air is sucked through the concentrated flow discharge hole 604c which serves as an air hole similar to those in the aforementioned embodiments and through the sleeve 606 into the main body 601, and thus the air is mixed with bubbles the water from the discharge port 605a. Then, this bubbly water is straightened by the baffle plates 604b and then is discharged from the distributor plate 604a.

When the main body 601 is rotated to be moved upwardly in the Figure, the sleeve 606 moves toward the valve seat ring 605, and the packing 606b ultimately rests on the valve seat ring 605. Thereby, the discharge port 605a communicates only with the interior of the cylindrical portion 606a of the sleeve 606, and a passage to the distributor hole 604a is shut off. Therefore, the water from the discharge port 605a flows into the cylindrical portion 606a without forming a conical water film, and thus the ordinary flow is discharged from the concentrated flow discharged port 604c.

Figures 40, 41:
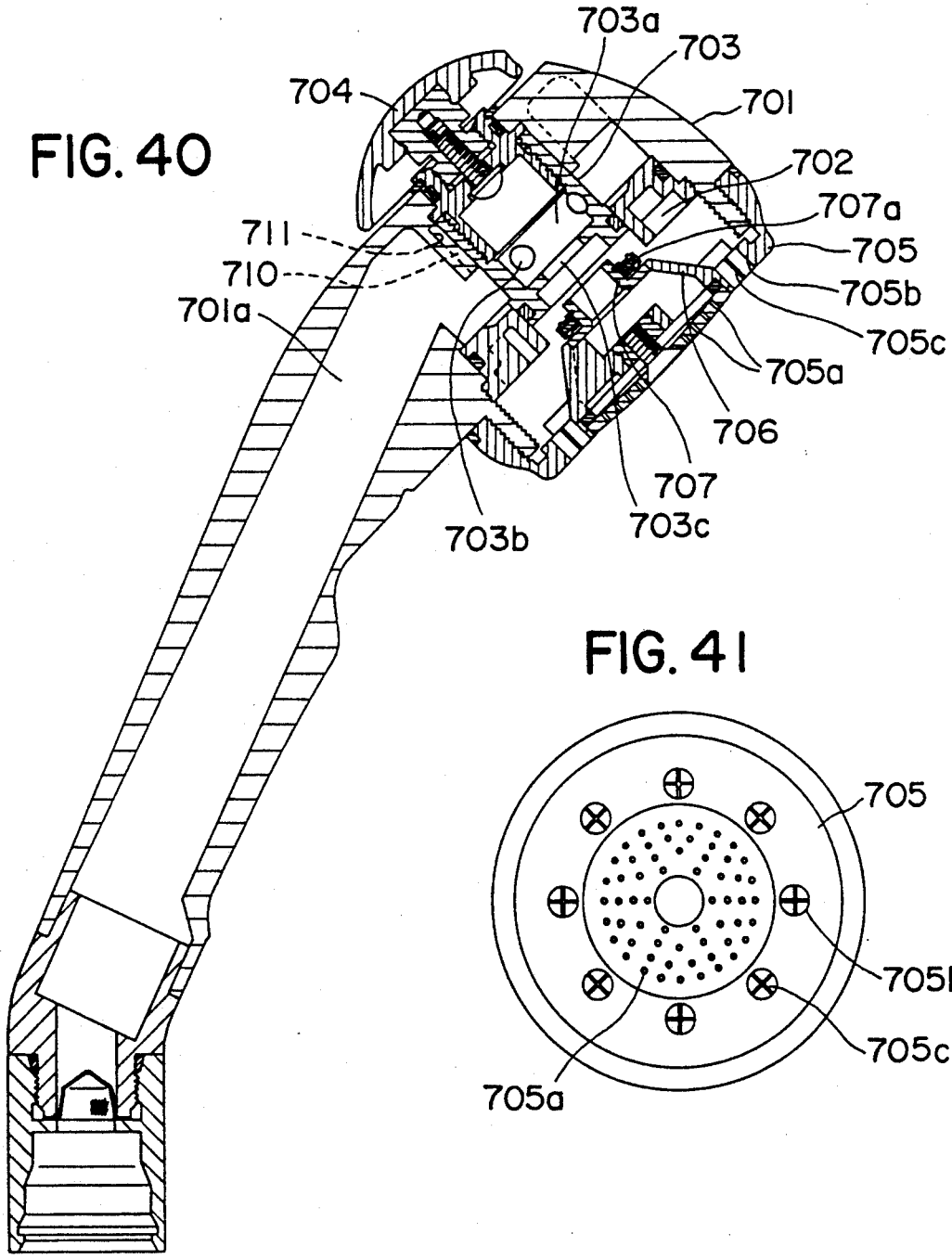
FIG. 40 is a longitudinally sectional view illustrating a major part of another embodiment assembled in a shower head.
FIG. 41 is bottom view of a discharge end.

FIG. 40 illustrates a longitudinally sectional view of an embodiment applied to a shower head, and FIG. 41 is a bottom view of the head.

In the Figures, an holder ring 702 is connected to an end of a main body 701 of a shower head, and an actuator 703 is slidably fitted into the holder ring 702. The actuator 703 is restrained at its outer peripheral surface by the main body 701 and the holder ring 702, so that it may be axially movable and may be prevented from the rotation.

That is, single or two axial projection liners 710 are provided at the periphery of the actuator 703. These liners 710 are slidably engaged into the grooves 711 provided at the sliding surface of the main body 701.

The actuator 703 has an upper end to which a select knob 704 is located at the outside of the main body 701. This select knob 704 is connected to the actuator 703 through a screw means 712 so that the actuator 703 may move in its axial direction without rotation around the axis thereof when the select knob 704 is rotated.

A swirl chamber 703*a* is formed at a position in which the actuator 703 is faced to the internal passage 701*a* in the main body 701, and is provided at its peripheral wall with a plurality of holes 703*b* which are arranged similarly to the aforementioned embodiment. The chamber 703 is also provided at its lower surface with a discharge port 703*c*.

A distributor plate 705 is fixed to the lower surface of the main body 701, which is provided, as shown in FIG. 41, at a radially inner portion with a plurality of spray holes 705*a* and at a radially outer portion with annularly arranged distributor holes 705*b* for the bubbly water flow. Similarly to other embodiments, cross-shaped baffle plates 705*c* are assembled in the distributor holes 705*b*, respectively. A cover 706 covering an area including spray holes 705*a* is fixed to the distributor plate 705 to form a hollow structure. A sleeve 706 is fixed to an upper end of the cover 706 and a packing 707*a* is disposed therearound for closely contacting the lower surface of the actuator 703.

In the embodiment in FIG. 40, similarly to that in FIG. 38, a conical water film is discharged from the discharge port 703*c* of the swirl chamber 703*a* toward the distributor plate 705 and the air is sucked through the cover 706 and the sleeve 707, because the sleeve 707 coaxial with the discharge port 703*c* is opened to the exterior through the spray holes 705*a* in the distributor plate 705. Therefore, the air is mixed with the water from the discharge port 703*c*, which forms the bubbly water to be discharged from the distributor holes 705*b*.

When the selector knob 704 is turned to move the actuator 703 toward the distributor plate 705, the lower surface of the actuator 703 contacts a packing 707*a* of the sleeve 707, and thus the passage to the distributor holes 705*b* is shut off.

Thereby, the water flows from the discharge port 703*c* into the sleeve 707, and is discharged and sprayed through the interior of the cover 706 from the spray holes 705*a*.

As described above, in the structures of the embodiments in FIGS. 38–41, selection can be effected between the bubbly flow and the concentrated flow or between the bubbly flow and the spray flow, and the passages for discharging the concentrated flow or the spray flow can be utilized as the air suction passage when the bubbly water is discharged, which allows the compact structures of the device, as can also be done in the embodiment described previously.

Figure 42:
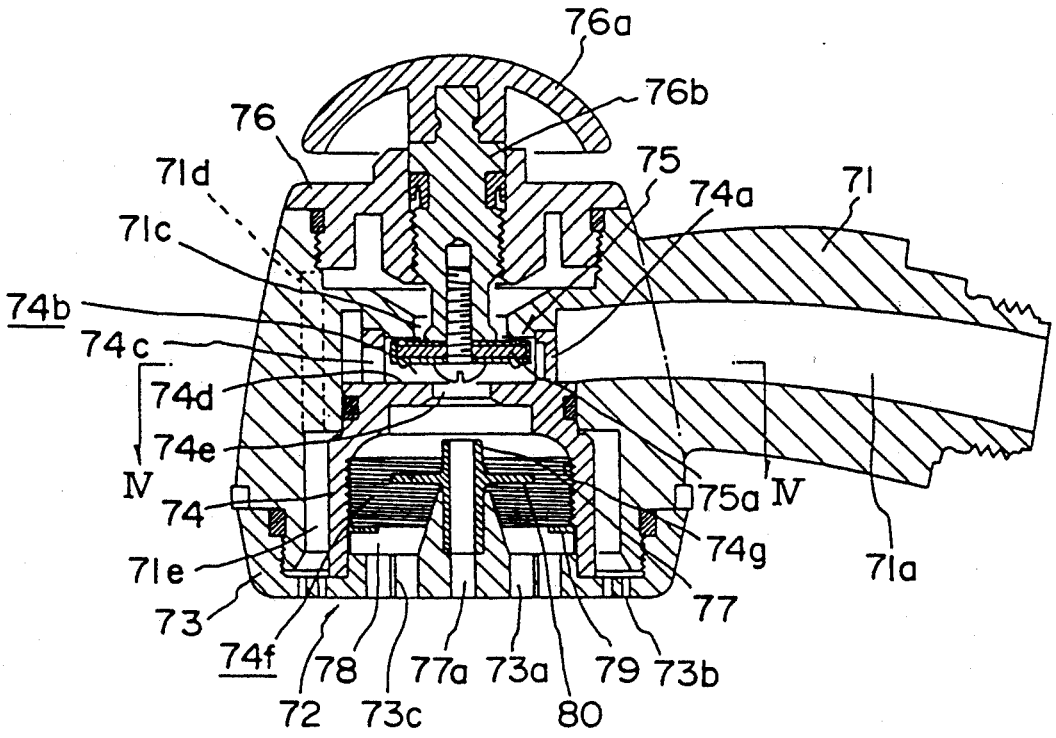
FIG. 42 is a longitudinally sectional view illustrating a major part of another embodiment assembled in a faucet of a hand shower type.
Figure 43:
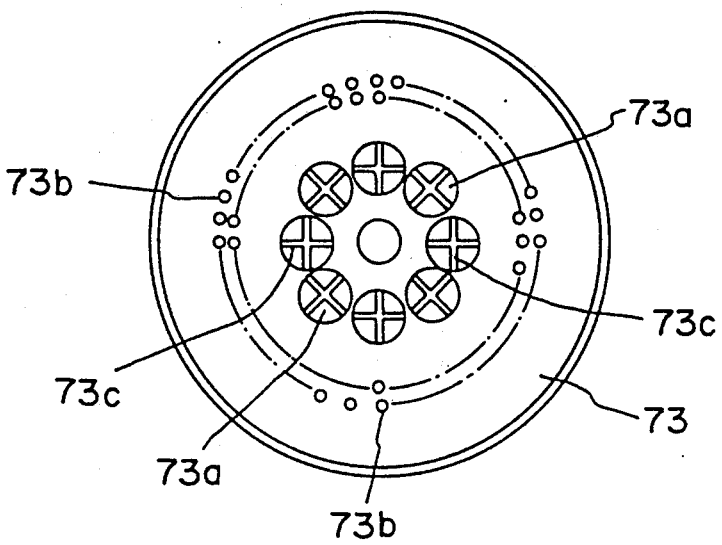
FIG. 43 is a bottom view of a discharge end.

FIG. 42 is a longitudinally sectional view of a faucet of a hand-shower type, in which the outlet structures of the invention are assembled. FIG. 43 is a bottom view of a distributor plate, and FIG. 44 is a sectional view taken along lines IV—IV in FIG. 42.

An outlet head 72 for selecting the spray and the bubbly flow is assembled in an end of the passage 71*a* provided in a body 71 of a hand-shower head. This outlet head 72 includes a distributor plate 73 fixed to the distal end of the body 71, and the bubbler block 74 fixed to the plate 73 and assembled in the body 71. The head 72 is also provided with a selector valve 75 which can allow flowing of the water from the passage 71*a* selectively toward the spray side and the bubbly flow side.

Figure 44:
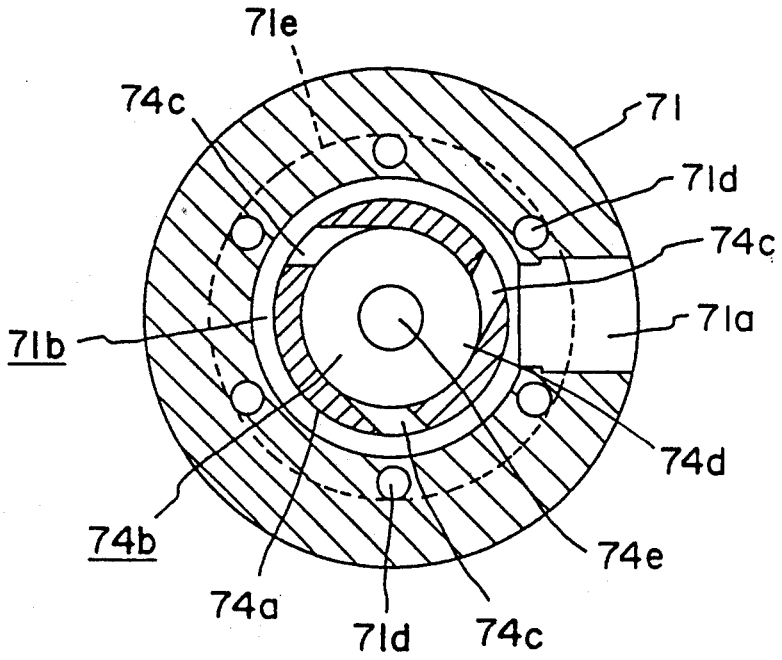
FIG. 44 is a sectional view taken along lines IV—IV in FIG. 42.

As shown in FIG. 44, at the top of the bubbly block 74, an annular wall 74*a* is formed and is coaxially assembled in a downstream end of the passage 71*a*, so that an annular primary chamber 71*b* is formed outside the wall 74*a* and a secondary chamber 74*b* is formed inside it. The wall 74*a* is provided with three holes 74*c* and is also provided at a center of a bottom wall 74*d* of the secondary chamber 74*b* with a discharge port 74*e*. A cylindrical bubbler chamber 74*f* having an increased capacity is formed under the discharge port 74*e*, and an internal thread 74*g* is formed at the inner periphery thereof.

The annular wall 74*a* at the top of the bubbler block 74 is closed by the inner wall of the body 71, and a passage port 71*c* for the spray flow is coaxially formed above the discharge port 74*e*. Six communication ports 71*d* extend downward in communication with the port 70*c* and are formed around the outlet head 72. Lower ends of these communication ports 71*d* are in communication with an annular passage 71*e* around the bubbler block 74 to form passages to the distributor plate 73.

A bushing 76 is attached to an upper end of the main body 71 and a spindle 76*b* fixed to a handle 76*a* for operating a selector valve 75 is rotatably attached thereto. A lower end of the spindle 76*b* is fixed to a valve body 75*a* of the selector valve 75 which is axially movable in the secondary chamber 74*b* of the bubbler block 74. This valve body 75*a* closes the passage extending to the passage ports 71*c* for supplying the water from the discharge port 74*e* to the bubbler chamber 75*f* to form the bubbly water flow, when it is in the illustrated position, and the passage is switched to the spray side when the handle 76*a* is operated to lower the valve body 75*a* and intimately contacting the lower surface thereof to the bottom wall 74*d* of the secondary chamber 74*b*.

The distributor plate 73 function is to straighten and discharge the bubbly water and has a suction structure for bubbling the water, in which distributor holes 73*a* in communication with the bubbler chamber 74*f* are provided at radially inner portion for bubbling the water and a large number of shower holes 73*b* in communication with the annular passage 71*e* are disposed around the holes 73*a* for spraying and discharging the water. Cross-shaped baffle plates 73*c* are disposed in the distributor holes 73*a*.

Figure 45:
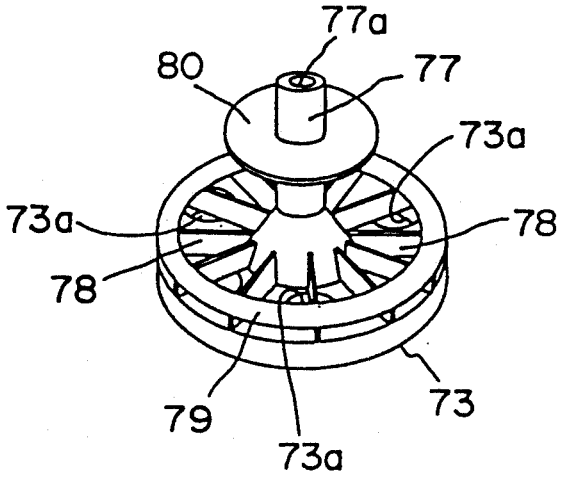
FIG. 45 is a perspective view of a distributor plate viewed from the above.

FIG. 45 is a perspective view illustrating an upper side of the distributor plate 73 contained in the bubbler chamber 74*f*. This distributor plate 73 is nearly the same as that shown in FIG. 33. That is; an air suction pipe 77 is coaxially extended upwardly from the center of the plate to form an air passage 77*a* therein. Twelve baffle vanes 78 are arranged on the upper surface thereof and are radially extended from the air suction pipe 77. An annular anti-pulsation plate 79 is attached to upper edges of the respective baffle vanes 78. As shown in FIG. 42, an upper end of the air suction pipe 77 is faced to the discharge port 74*e* of the bubbler block 74, and a nonreturn plate 80 for preventing a reverse flow of the water supplied from the discharge port 74*e* is also arranged.

When the water is supplied from the passage 71*a*, the water is swirled and supplied into the bubbler chamber 74*f* in the form of the water film F, as is done in the embodiment described above. The air is sucked through the air passage 77*a* and the water film F from the discharge port 74*e* collides with the internal thread 74*g* of the bubbler chamber 74*f* to be dispersed and mixed with the air, and thus the bubbly water is produced. Then, the bubbly water flows into the distributor holes 73a and is discharged after being straightened by the baffle plates 73c.

In the above structures, when it is intended to discharge the bubbly water from the distributor holes 73a, the valve body 75a is moved upwardly to close the passage hole 71c and to open the discharge port 74e, as shown in FIG. 42. By this operation, the water in the bubbler chamber 74f forms the water film, and is bubbled by the mixed air sucked through the air suction pipe 77. The bubbly water is ultimately straightened by the cross-shaped baffle plates 73c, and then is discharged through the distributor holes 73a.

On the other hand, when the handle 76a is operated to lower the bubble body 75a, the lower surface thereof rests on the valve seat, i.e., the bottom wall 74d of the secondary chamber 74b to close the discharge port 74e, and simultaneously the passage hole 71c formed in the body 71 is opened. Thereby, the water from the passage 71a flows through the passage hole 71c and the communication holes 71d into the annular passage 71e around the bubbler block 74, and then is discharged in the form of the spray flow from the distributor holes 73b in the distributor plate 73.

Therefore, by switching the selector valve 75, it is possible to selectively use the bubbly water formed by the bubbler block 74 and the spray flow through the distributor holes 73b. As described before, since the bubbles can be sufficiently formed even at a low flow rate, it can be used for washing the face and hair with no disadvantage.

Since the valve body 75a of the selector valve 75 is assembled by utilizing the the secondary chamber 74b of the bubbler block 74 which serves to swirl the flow for bubbling the water, the outlet head 72 can have smaller sizes than those, e.g., having separated passages for the spray flow and bubbly flow. That is; since the spray flow and the bubbly flow are selected by the valve having the common spindle, the structures can be simpler than those having two valves exclusively used for the respective flows. Particularly, since the valve body 75a is assembled by using the secondary chamber 74b required for swirling the flow, a space exclusively used for the selector valve 75 is not required. Accordingly, the selector valve 75 having both functions for the bubbly flow and the spray flow occupies the minimum space, resulting in compact structures.

Figure 46:
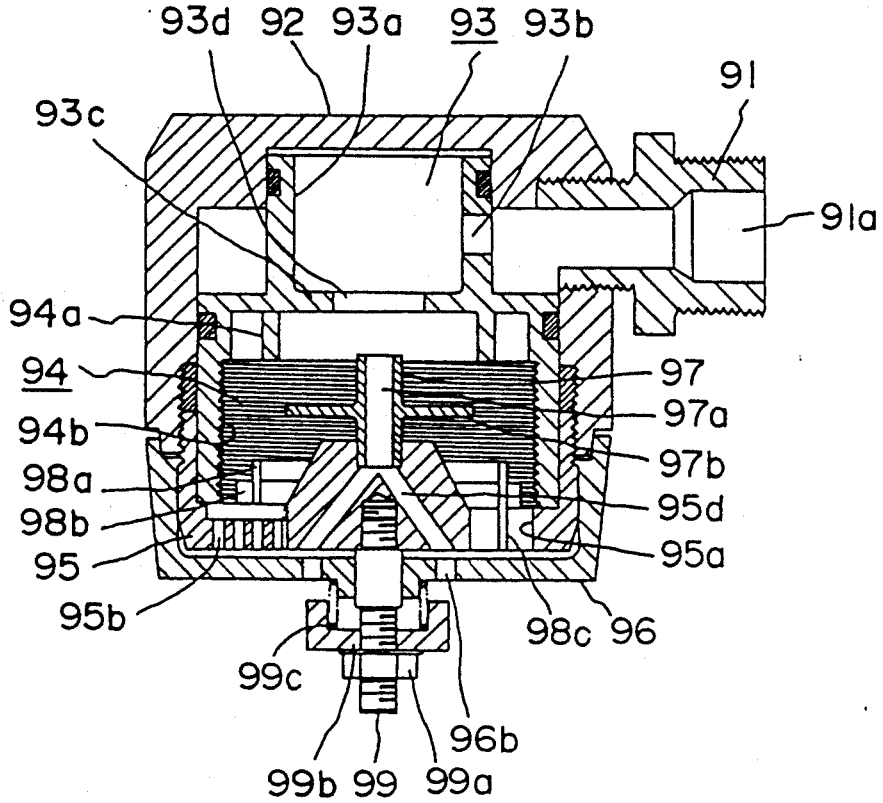
FIG. 46 is a longitudinally sectional view of a major part of another embodiment of a bubbly water outlet device including structures for selecting a bubbly water flow and an ordinary flow.
Figure 47:
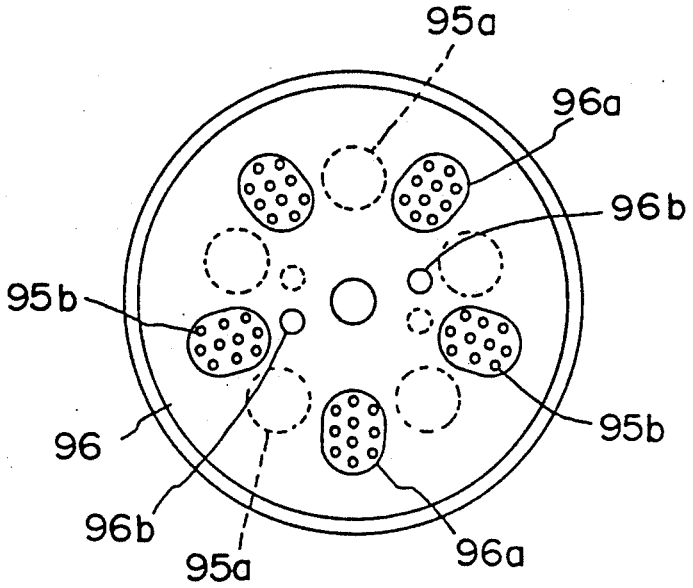
FIG. 47 is a bottom view of a distributor plate.
Figure 48:
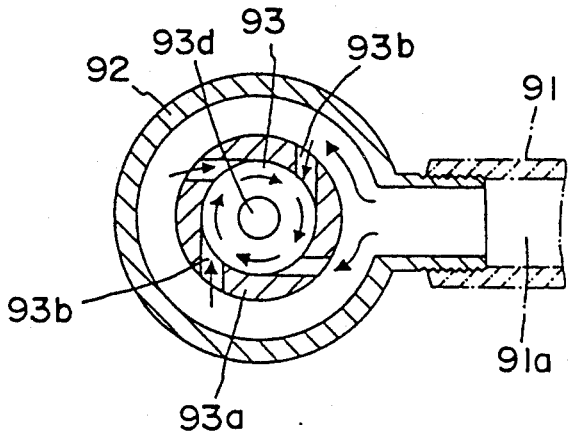
FIG. 48 is a schematic cross sectional view illustrating swirling of water.

FIG. 46 is a longitudinally sectional view of an embodiment including another selector mechanism, FIG. 47 is a bottom view of a distributor plate and FIG. 48 is a schematic cross sectional view illustrating swirling of the water.

In the Figures, a body 92 of the outlet head for selecting the spray flow and the bubbly flow is connected to an end of a water supply pipe 91, and the interior thereof is connected to a passage 91a in the water supply pipe 91. The outlet head body 92 of a cylindrical form having an open lower end is provided at an interior thereof with a swirl chamber 93 and a bubbler chamber 94, and is also provided at a lower end with a fixed distributor plate 95 and a movable distributor plate 96 fixed thereto.

The swirl chamber 93 is formed inside an annular wall 93a, similarly to the aforementioned embodiments, which is provided with four holes 93b, and a discharge port 93d is provided at a partition 93c between the swirl chamber 93 and a bubbler chamber 94.

The bubbler chamber 94 which is of a cylindrical shape is formed integrally with the swirl chamber 93 by a common member, and has an open lower end having an inner diameter larger than that of the swirl chamber 93. An annular nonreturn plate 94a having an inner diameter nearly the same as that of the swirl chamber 93 is formed around the discharge port 93d, and an internal thread 94b for promoting the bubbling is formed at a portion of the inner peripheral wall lower than the plate 94.

Figure 49A:
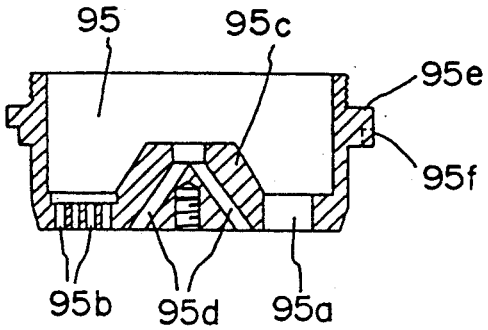
FIG. 49(*a*) is a longitudinally sectional view of a fixed distributor plate.
Figure 49B:
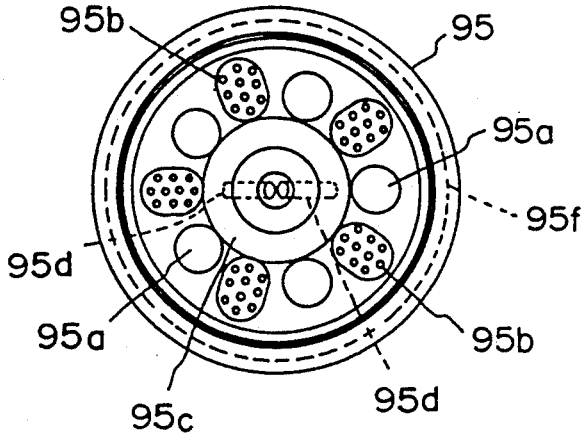
Figure 51:
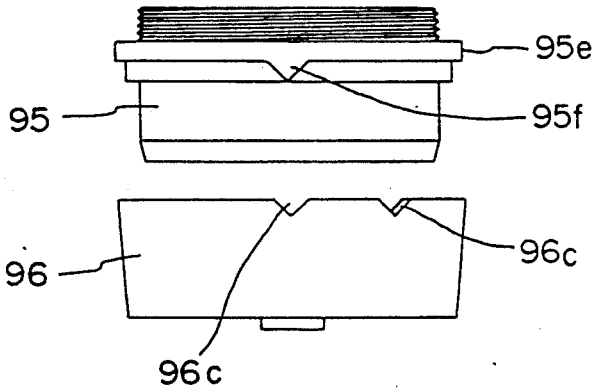
FIG. 51 is an exploded elevation view of fixed and movable distributor plates.
Figure 52:
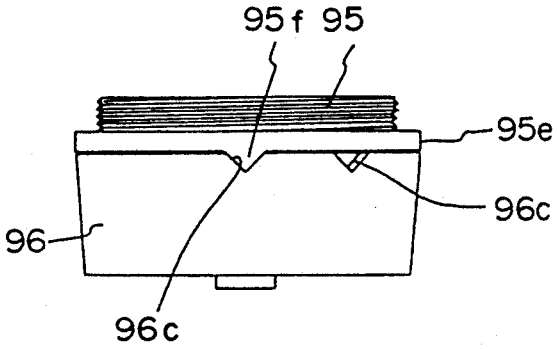
FIG. 52 is an elevation view of fixed and movable distributor plates assembled together.

The fixed distributor plate 95 is attached to the lower end of the body 92 by a thread engagement, and has a flat lower surface as well as bubbly flow holes 95a, spray holes 95b and air suction holes 95d therein, as shown in detail in FIG. 49. The bubbly water holes 95a having circular sections are five in number and are arranged around the center of the plate. The spray holes 95b are formed by a large number of small holes which are grouped in five elliptical regions which are located between the bubbly water holes 95a. A base 95c having a large thickness is formed in the center of the plate, and the two air suction holes 95d are formed therein. Lower open ends of these suction holes 95d are aligned in a radial direction. Further, an peripheral wall of the fixed distributor plate 95 is provided with a flange 95e, which is provided at a lower surface thereof with a triangular protrusion 95f, as shown in FIG. 51.

As shown in FIG. 46, an air suction pipe 97 is connected to the base 95c of the fixed distributor plate 95, and a passage therein is connected to the air suction holes 95d. An air passage 97a in the air suction pipe 97 is located coaxially with the discharge port 93d and has an upper end adjacent to the discharge port 93d. Around the air suction pipe 97 is disposed a circular disk-like nonreturn plate 97b, which cooperates with the nonreturn plate 94a in the bubbler chamber 94 to prevent the bubbly water from closing the air passage 97a.

The fixed distributor plate 95 is provided at its bottom with a plurality of radial baffle plates 98b which extend radially from its center as well as a cylindrical and annular baffle plate 98a, and crossshaped baffle plates 98c are assembled in the bubbly water holes 95a.

Figure 50A:
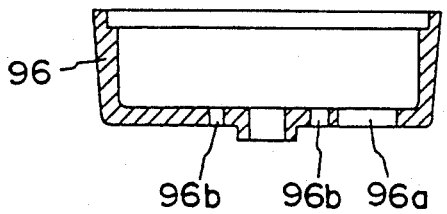
FIG. 50(*a*) is a longitudinally sectional view of a movable distributor plate.
Figure 50B:
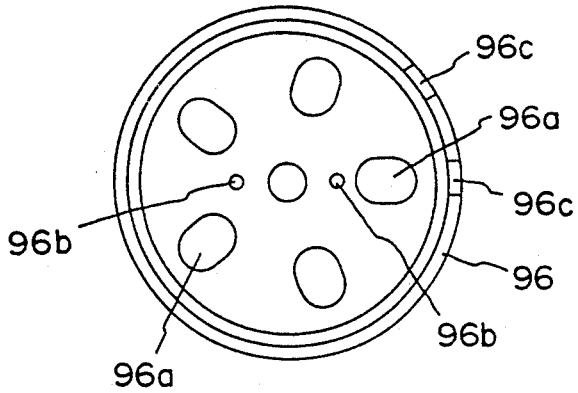

The movable distributor plate 96 is rotatable around the fixed distributor plate 95 and functions to open the air suction hole 95d to the atmosphere simultaneously with opening of the bubbly water hole 95a and to close the air suction holes 95d simultaneously with switching to the spray holes 95b. FIG. 50 specifically illustrates the movable distributor plate 96, in which five water holes 96a and two air holes 96b are opened in the bottom wall. The water holes 96a have elliptical opening areas which cover the groups of spray holes 95b, respectively, and thus the layout pitches of the holes 96b are equal to those of the bubbly water holes 95a or the spray holes 95b.

The movable distributor plate 96 is further provided at two portions of an upper edge thereof with engagement grooves 96c into which the protrusion 95f on the fixed distributor plate 95 can be fitted. An circumferential distance between these engagement grooves 96c corresponds to the pitch of the adjacent bubbly water holes 95a and the spray holes 95b. As shown in FIG. 46, the movable distributor plate 96 is rotatably assembled around a bolt 99 screwed into the base 95c, and is biased toward the fixed distributor plate 95 by means of a spring 99c and a retainer ring 99b held by a nut 99a. Owing to these attaching structures, when the movable distributor plate 96 is rotated to select an intended water flow, the protrusion 95*f* is disengaged from one of the engagement grooves 96*c* and is reengaged with the other engagement groove 96*c*, and thus is unrotatably fixed to the fixed distributor plate 95, so that the intended flow can be selected.

In the above structures, when the bubbly water is to be discharged, the movable distributor plate 96 is rotated from the position in FIG. 47 to align the water holes 96*a* with the bubbly water holes 95*a* as well as to align the air holes 96*b* with the air suction holes 95*d*. Thereby, the bubbly water formed as described above in the bubbler chamber 94 is discharged through the bubbly water holes 95*a* and the water holes 96*a*.

When the spray flow is planned, the movable distributor plate 96 is rotated in a similar manner to engage the protrusion 95*f* with the engagement groove 96*c* and align the water holes 96*a* with the spray holes 95*b*, as shown in FIG. 47. In this operation, the air holes 96*b* are disconnected from the air suction holes 95*d*, so that the air suction holes 95*d* are closed by the bottom wall of the movable distributor plate 96. Therefore, the supplied water is swirled in a manner similar to the bubbly water, and is flowed into the bubbler chamber 94, but the bubbling or bubble formation is not effected because the air is not sucked. Accordingly, the supplied water forms the continuous flow into the bubbler chamber 94 and is discharged, in the form of the ordinary shower flow, through the spray holes 95*b* and the water holes 96*a*. As described above, by operating and rotating the movable distributor plate 96, the bubbly water flow and spray flow can be selected, and thus the device can be used for washing the face and hair with no disadvantage.

Since the movable distributor plate 96 is used to select a flow mode, it is necessary neither to incorporate a selector valve in the outlet head nor to provide independent passages for the spray flow and bubbly water flow extending up to the discharge end. Therefore, the outlet head can be compact, minimizing a space to be occupied by the selector valve, in spite of the fact that two types of functions for the bubbly flow and the spray flow are included.

Figure 53:
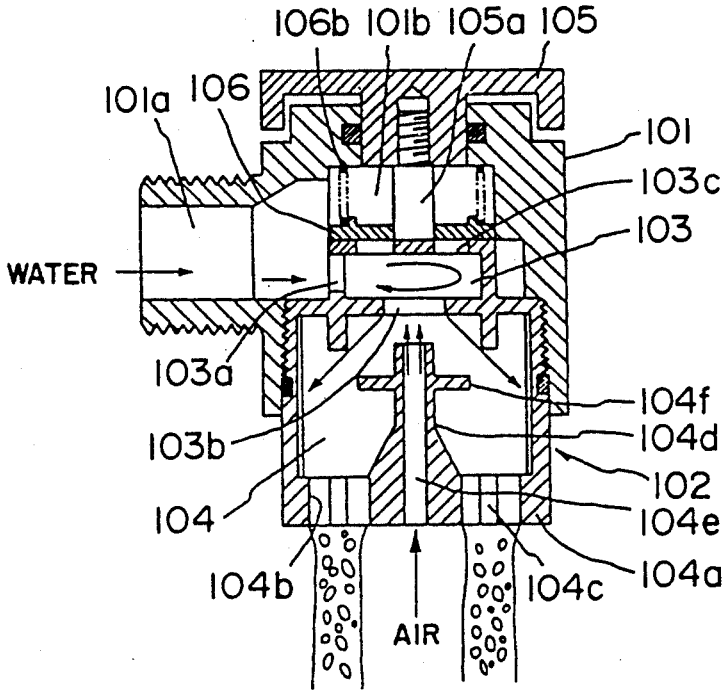
FIG. 53 is a longitudinally sectional view of a major part of another embodiment of a bubbly water outlet device including other structures for selecting a bubbly water flow and, an ordinary flow.
Figure 54:
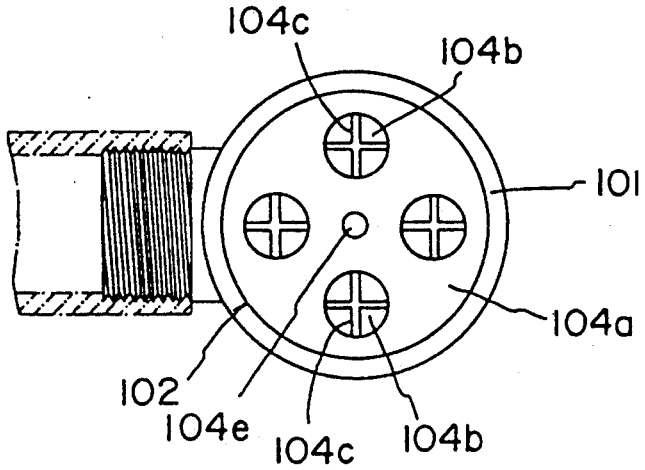
FIG. 54 is a bottom view.

FIG. 53 is a longitudinally sectional view illustrating another embodiment of a structure for selecting the bubbly flow and the straight flow, and FIG. 54 is a bottom view thereof.

A laterally extending passage 101*a* is formed in a body 101 of an outlet, and an outlet head 102 is fixedly assembled in the lower end of the body 101. The passage 101*a* has a form diverging toward the center of the body 101 and has a circular cross section at its downstream end so as to form a selector chamber 101*b* for the bubbly water flow and four straight flows.

The outlet head 102 includes a swirl chamber 103 located in the selector chamber 101*b* and a bubbler chamber 104 projected from the bottom surface of the body 101, and the chambers 103 and 104 are coaxial with each other and have circular sections.

The swirl chamber 103 has a cross section similar to that in the embodiments of FIGS. 36 and 48 and is provided at a peripheral wall with four holes 103*a* as well as a discharge port 103*b* located at a partition between the chambers 103 and 104. At the upper end of the swirl chamber 103 is provided with two auxiliary holes 103*c* which are point symmetrical to each other with respect to the center of the chamber 103 for allowing communication between the swirl chamber 103 and the selector chamber 101*b*.

The bubbler chamber 104 has an lower end formed by a distributor plate 104*a*, in which four distributor holes 104*b* accommodating cross-shaped baffle plates 104*c* are formed, as shown in FIG. 54. An air suction pipe 104*b* which is coaxial with the discharge port 103*b* is located at the center of the chamber, and an upper end thereof is located near the discharge port 103*b*. An air passage 104*e* in the pipe 104*d* is connected to the atmosphere. In the vicinity of the upper end of the air suction pipe 104*d*, a circular nonreturn plate 104*f* is provided for preventing the bubbly water from reversely flowing into and closing the air passage 104*e*.

Figure 55:
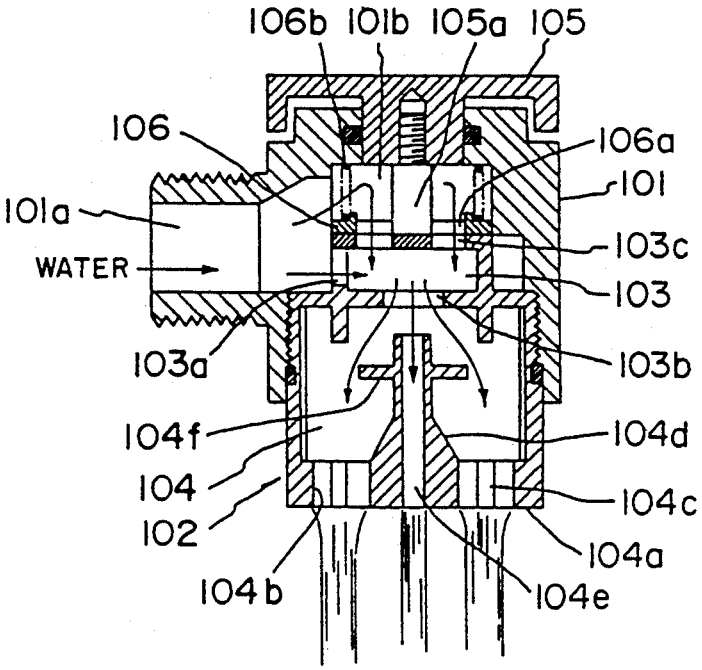
FIG. 55 is a longitudinally sectional view illustrating a condition switched to a straight flow discharging.

Meanwhile, a selector handle 105 is rotatably attached to the upper end of the body 101, and a valve body 106 is attached to an lower end of a spindle 105*a* arranged coaxially with the swirl chamber 103. This valve body 106 is formed by a circular plate, as shown in FIG. 55, including two valve holes 106*a* which can be aligned with the auxiliary holes 103*c* for the swirl chamber 103. The valve body 106 is assembled to slide on the upper surface of the swirl chamber 103 so as to form a valve structure, and is biased by a spring 106*b* located in the selector chamber 101*b* toward the swirl chamber 103. The valve holes 106*a* and auxiliary holes 103*c* may have same inner diameter, and may be arranged on a common circle, in which case, by rotating the selector handle 105 through 90 degrees from the closed position in FIG. 53, the valve mechanism can be fully opened as shown in FIG. 55, and opening degree can also be arbitrarily controlled by adjusting the rotation degree.

In FIG. 53, the valve body 106 closes the auxiliary holes 103*c*, and the passage 101*a* is in communication only with the holes 103*a* at the peripheral wall of the swirl chamber 103. In this position, the distributor holes 104*b* discharge the bubbly water.

When the water is supplied from the passage 101*a*, the water from the swirl chamber 103 flows in the form of the water film into the bubbler chamber 104, and simultaneously, due to the reduction of the pressure, the air is sucked through the air passage 104*e*, so that the water dispersed by the collision of the water film from the discharge port 103*b* with the inner wall of the bubbler chamber 104 is mixed with the air and thus is bubbled. The bubbly water thus bubbled flows into the distributor hole 104*b*, and is discharged after being straightened by the baffle plate 104*c*.

As described above, by closing the auxiliary holes 103*c* by the valve body 106 and by supplying the water only through the holes 103*a*, swirling of the water, forming and supplying of the water film, sucking of the air and bubbling are effected, and thus the bubbly water can be discharged.

By rotating the selector handle 105 to align the valve holes 106*a* with the auxiliary holes 103*c* as shown in FIG. 55, the water flows into the swirl chamber 103 through the holes 103*a* in the peripheral wall and auxiliary holes 103*c*. In this operation, the water fed through the holes 103*a* tends to swirl the flow in the swirl chamber 103, as already described with reference to the discharging of the bubbly flow. However, the water is also fed from the auxiliary holes 103*c* in a direction nearly perpendicular to this swirling flow toward the discharge port 103*b*. Therefore, the water from the holes 103*a* is interfered by the longitudinal flow which is advancing directly toward the discharge port 103*b* from the auxiliary holes 103*c*. Accordingly, the swirling force of the flow is reduced, and thus the water from the discharge port 103*b* does not form the water film and forms the ordinary continuous flow.

In these flows, the flow velocity in the bubbler chamber 104 is not increased, so that the air is not sucked through the air passage 104*e*. Accordingly, the water in the bubbler chamber 104 is not bubbled, and is discharged from the distributor holes 104*b*, taking the form of the ordinary straight flow which has been straightened by the baffle plates 104*c*.

The degree of the bubbling can be controlled by the aligning relationship between the auxiliary holes 103*c* and the valve holes 106*a* in the valve body 106. If the aligning degree of the valve is relatively small, the flow rate in the holes 103*a* increases, and the flow rate of the water from the auxiliary holes 103*c*, which interferes with the swirling force, decreases, so that the bubbly water can be discharged owing to the residual swirling force. When the aligning degree is gradually increased, the swirling force gradually decreases and the bubbles are ultimately eliminated, resulting in the ordinary flows. Thus, in addition to the selection of the straight flow including four streams and the bubbly flow, the bubbling degree can be controlled.

Figure 56:
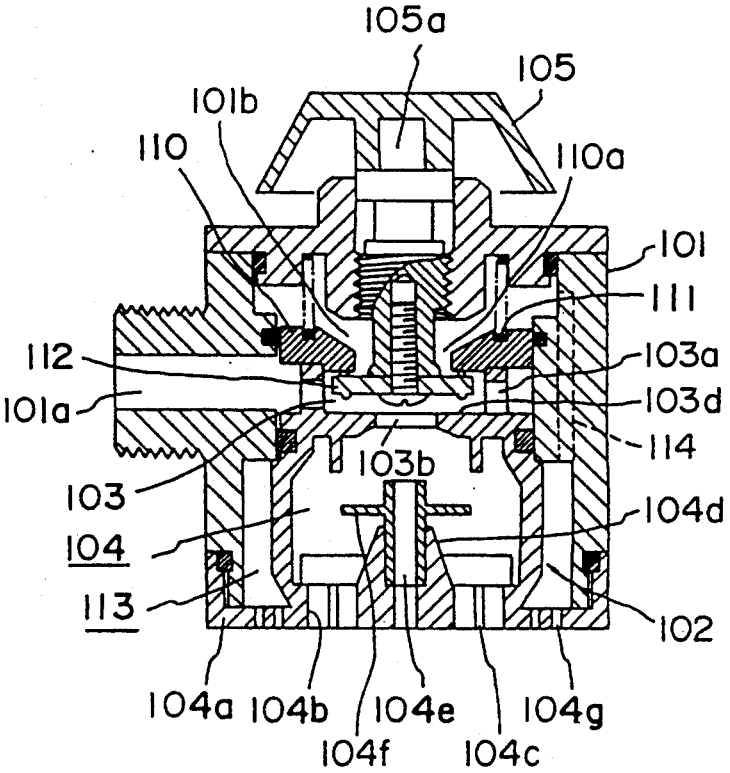
FIG. 56 is a longitudinally sectional view of another embodiment of a selector mechanism.

FIG. 56 is a longitudinally sectional view of an embodiment, in which three forms of the discharged water can be selected.

Similarly to the embodiment in FIG. 53, the outlet head 102 is assembled in the body 101, and the selector handle 105 is arranged so as to allow selection of the bubbly water flow, plural spray flow and spray (straightened) flow. The structure of the selector valve and the passages for the spray flow are modified.

The swirl chamber 103 at the upper portion of the outlet head 102 has an open upper end, and an auxiliary valve body 110 for opening and closing the passage between the selector chamber 101*b* and the passage 101*a* is disposed at the upper portion thereof. This auxiliary valve body 110 is slidable coaxially with the outlet head 102 in the body 101, and is biased by a spring 111 toward the outlet head 102. An auxiliary hole 110*a* is formed at the center of the auxiliary valve body 110, and the spindle 105*a* of the selector handle 105 is inserted into this auxiliary hole 110*a*. A valve body 112 provided at the lower end of the spindle 105*a* is disposed in the swirl chamber 103, and is adapted to be axially moved so as to contact or leave a lower surface of the valve body 110 and an upper surface of the bottom wall 103*d* of the swirl chamber 103.

An annular auxiliary passage 113 is formed between the outer periphery of the bubbler chamber 104 and the inner periphery of the main body 101, and is connected to the selector chamber 101*b* through a plurality of communication passages 114 provided at the body 101. A large number of small spray holes 104*g* to be connected to the auxiliary passage 113 are provided at the distributor plate 104*a*.

Other structures are substantially same as those in FIG. 53, and same members bear same reference numbers.

In the above structures, the valve body 112 in the illustrated position closes the auxiliary hole 110*a* in the auxiliary valve body 110, and the auxiliary valve body 110 itself shuts off the passage 101*a* from the selector chamber 101*b*. Thus, the passage 101*a* is in communication only with the swirl chamber 103, and in a same manner as that in the aforementioned embodiment, the water swirled in the swirl chamber 103 is supplied in the form of the water film from the discharge port 103*b* into the bubbler chamber 104 and then the bubbly water is discharged from the distributor holes 104*b*.

Figure 58:
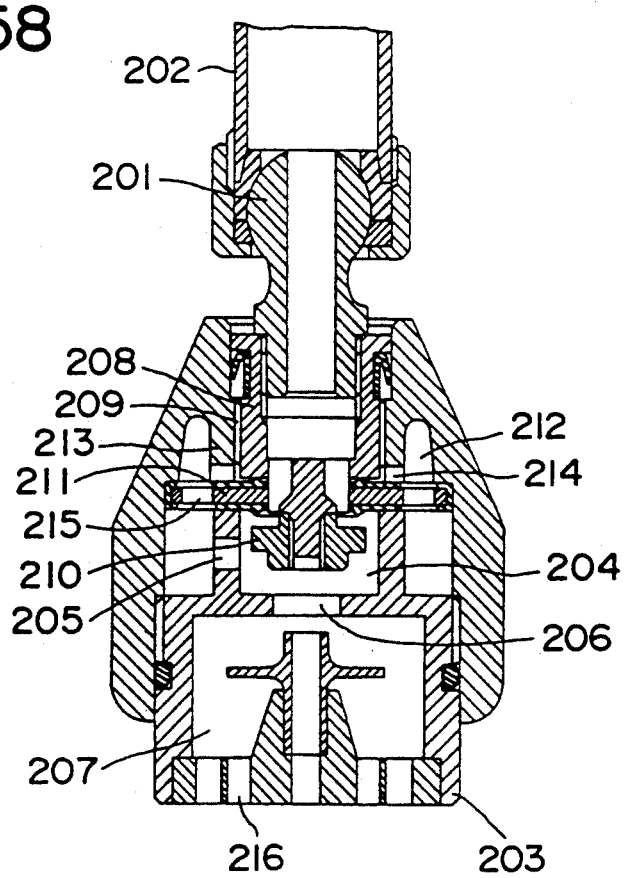
FIG. 58 is a longitudinally sectional view illustrating a condition for discharging a shower flow.

When the selector handle 105 is operated to move the spindle 105*a* upwardly, the auxiliary valve body 110 is pushed upwardly by the valve body 112. Thereby, the auxiliary valve body 110 moves away from the upper end of the swirl chamber 103 to connect the passage 101*a* to the selector chamber 101*b*, and thus the water flows into the swirl chamber 103 through the holes 103*a* in the peripheral wall of the swirl chamber 103 and through the selector chamber 101 and the auxiliary holes 101*a*. Thus, same flow as those in FIG. 58 is formed which weakens the swirl in the swirl chamber 103 and the continuous flow is supplied into the bubbler chamber 104. Accordingly, the ordinary straight flow is discharged from the distributor holes 104*b* through the bubbler chamber 104.

Further, the spindle 105*a* may be lowered by the selector handle 105 so that the valve body 112 may close the discharge port 103*b*. In this case, the water flowed into the swirl chamber 103 is supplied through the auxiliary hole 110*a* and the selector chamber 101*b* and further through the communication passages 114 into the auxiliary passage 113. Therefore, the water which takes a form of the spray flow having small stream lines is discharged from the distributor holes 104*g* in the distributor plate 104*a*. By the provision of the valve body 112 and the auxiliary valve body 110 for the selection, three types of flows, i.e., the bubbly water flow and straight water flow from the distributor holes 104*b* as well as the spray flow from the spray holes 104*g*, can be obtained. Accordingly, by operating the selector handle 105, the form of the discharged flow can be appropriately selected, e.g., for optimum use in washing a face and hair.

Since the selector valve has a slidable valve structure, the sizes of the valve mechanism can be small, and thus the outlet can be compact. Since the common distributor plate can be used for the bubbly flow and the straight flow, the auxiliary passage to which the water can be supplied may be provided outside the bubbler chamber, in which case three types of flows can be obtained, allowing comfortable use for respective purposes.

Figure 57:
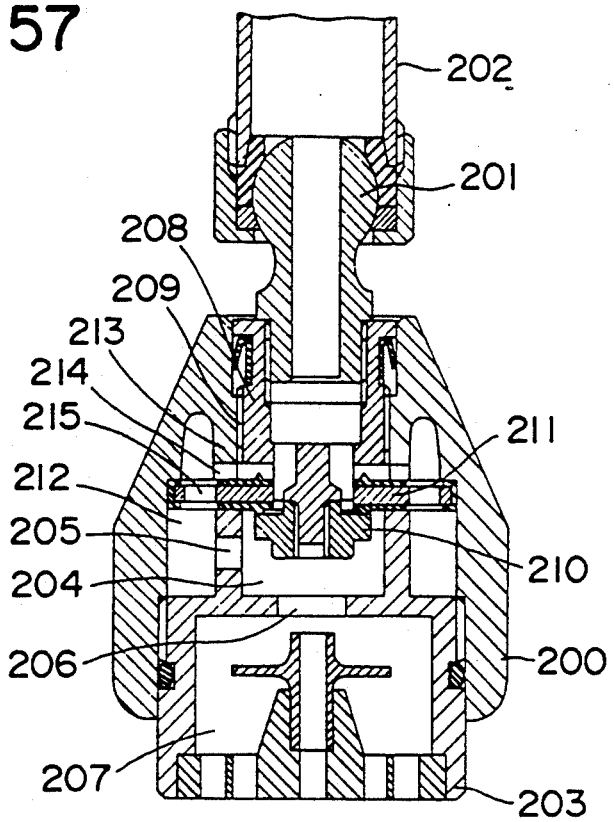
FIG. 57 is a longitudinally sectional view of a major part of another embodiment of a bubbly water outlet device including structures for selecting a bubbly water flow and an ordinary flow.

FIGS. 57 and 58 illustrate an embodiment in which an outlet device of the invention is incorporated in a spray head. In this embodiment, a straight flow and a bubbly flow can be selectively discharged by means of a selector valve similar to that show in FIG. 53.

In FIG. 57, a main body 200 of the spray head has an upper end which is connected to an upper end of a water supply pipe 202 through a swivel joint 201 and has a lower end fixed to a distributor plate 203 which is similar to that shown in FIG. 55. At an upper end of the distributor plate 203 is formed a swirl chamber 204, of which peripheral wall is provided with a hole 205. A bottom wall of this swirl chamber 204 is provided with a discharge port 206, and a bubbler chamber 207 is formed below it. The main body 200 is jointed to a block 208 fixed to the joint 201 through a thread 209, and the illustrated main body 200 may be rotated to move vertically.

The swirl chamber 204 has an open upper end which may connect to a passage from the water supply pipe 202 through a selector valve which is assembled therein to selectively open and close this passage. This selector valve consists of a fixed valve seat 210 fixed to the block 208 and a movable valve body 211 fixed to the main body 200. The movable valve body 211 having a diameter larger than that of the swirl chamber 204 is disposed coaxially with it and is projected into a communication passage 212 having an annular cross section and formed in the main body 200. An annular partition 213 is formed in the main body 200, and an annular wall thereof is provided with an opening 214 which has a height enough to allow vertical movement of the movable valve body 211. A portion of the movable valve body 211 projected into the communication passage 212 is provided with a plurality of holes 215 so as to connect the upper and lower portions of the communication passage 212 located at opposite sides of the movable member 211 and also to supply the water to the hole 205 of the swirl chamber 204.

The main body 200 illustrated in FIG. 57 is in a lowest position, in which the movable body 211 rests on the fixed valve seat 210 to close a passage to the swirl chamber 204 and open only a passage from the opening 214 to the communication passage 212. Thus, the water flows from the opening 214 to the communication passage 212 and then flows through the hole 215 in the movable valve body 211 to a peripheral portion of the swirl chamber 204. Therefore, the water flowed from the hole 205 into the swirl chamber 204 forms a swirling flow, and then is bubbled in the bubbler chamber 207 before being discharged from the distributor holes 216 in the distributor plate 203.

When the main body 200 is rotated to move upwardly, as shown in FIG. 58, the movable valve body 211 is separated from the valve seat 210, and simultaneously the upper surface of the movable valve body 211 rests on the lower surface of the block 208. Therefore, the passage to the communication passage 212 is shut off, and the water directly flows into the swirl chamber 204 from the above. Accordingly, the water does not substantially swirl in the swirl chamber 204 and the water is discharged in the form of the straight flow from the distributor holes 216 without being bubbled.

Instead of the selector valve in the form of the slide valve shown in FIG. 55, the main body 200 of the spray head may be utilized to operate the selector valve, which achieves further compact structures.

Figure 59:
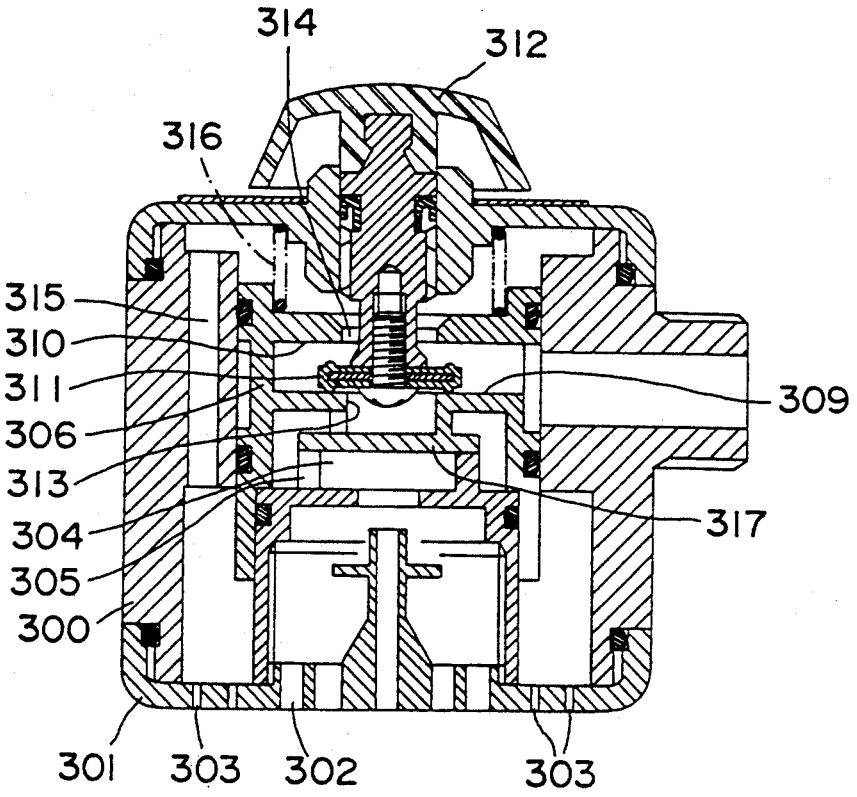
FIG. 59 is a longitudinally sectional view of a major part of another embodiment of a bubbly water outlet device capable of selectively discharging three types of flows.
Figure 60:
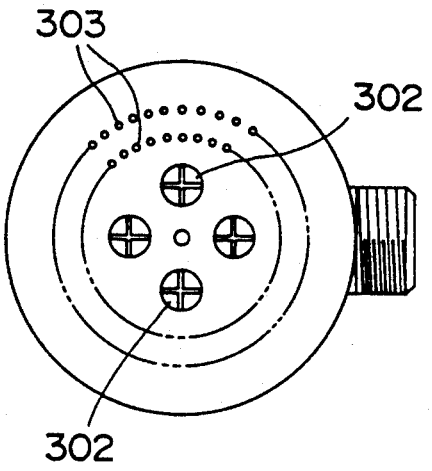
FIG. 60 is a bottom view of a distributor plate.

FIG. 59 is a longitudinally sectional view of a major part of another embodiment modified with respect to that in FIG. 56, and FIG. 60 is a bottom view.

In the Figures, a distributor plate 301 is fixed to a lower end of a main body 300 of an outlet head. Similarly to that in FIG. 56, this distributor plate 301 is provided at a radially inner side with distributor holes 302 for discharging bubbly water and is provided at a radially outer portion with a plurality of spray holes 303. A swirl chamber 304 having a peripheral wall provided with holes 305 is located in a selector valve block 306, and a discharge port 307 provided at a bottom wall thereof is in communication with a bubbler chamber 308. The selector valve block 306 is provided with a lower valve seat 309 and an upper valve seat 310, and a valve body 311 adapted to selectively rest on these valve seats 309 and 310 is also provided. The valve body 311 is adapted to be vertically moved by a rotating operation of a handle 312 projected from an upper end of the main body 300.

The lower valve seat 309 is provided with a valve hole 313 for forming a passage to the holes 305 of the swirl chamber 304. A valve hole 314 at the upper valve seat 310 is in communication with a communication passage 315 which has an annular cross section and is formed between an outer side of the selector block 306 and an inner periphery of the body 300. This communication passage 315 is faced to the spray holes 303 in the distributor plate 301 so as to discharge the water in the form of a spray flow from the selector valve block 306.

The selector valve block 306 is vertically movably assembled in the main body 300, and is downwardly biased by a spring 316 disposed between the upper wall of the main body 300 and the block 306. The swirl chamber 304 has an open end, which is closed by a plate 317 integrally formed in the selector valve block 306.

In a position illustrated in FIG. 59, only the valve hole 314 is open, so that the water is not supplied into the swirl chamber 304, and is discharged in the form of the spray flow through the communication passage 315 from the spray holes 303.

Figure 61:
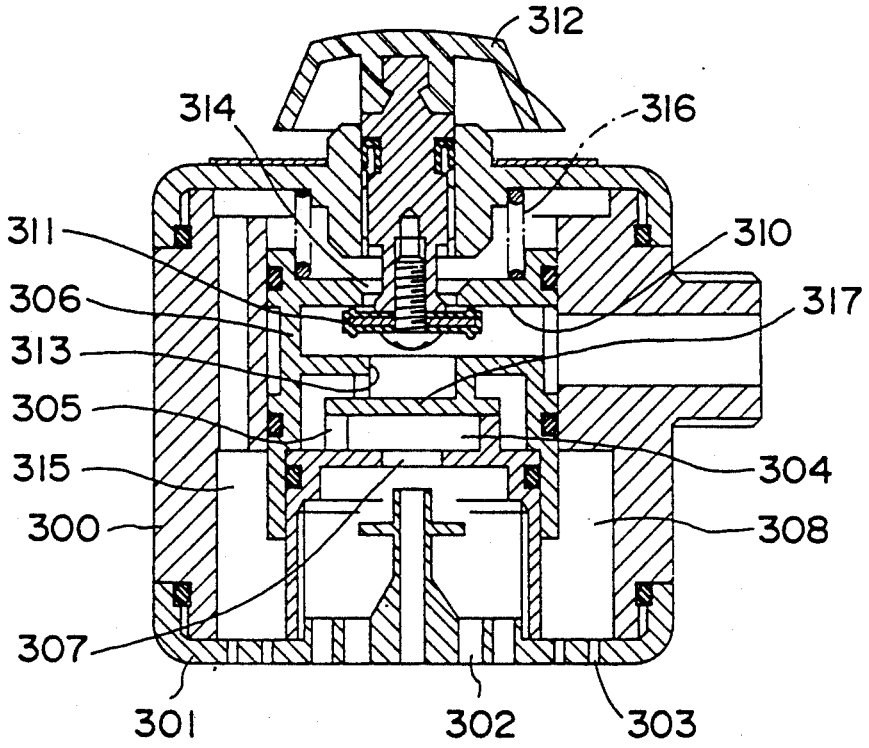
FIG. 61 is a longitudinally sectional view illustrating a condition set for discharging a bubbly water flow.

In a position shown in FIG. 61, the valve body 311 is moved upwardly by means of the handle 312 to close the valve hole 314 and open the valve hole 313. In this position, the water in the selector valve block 306 is fed through the hole 305 to the swirl chamber 304, and is discharged from the distributor hole 302 after being bubbled in the bubbler chamber 308.

Figure 62:
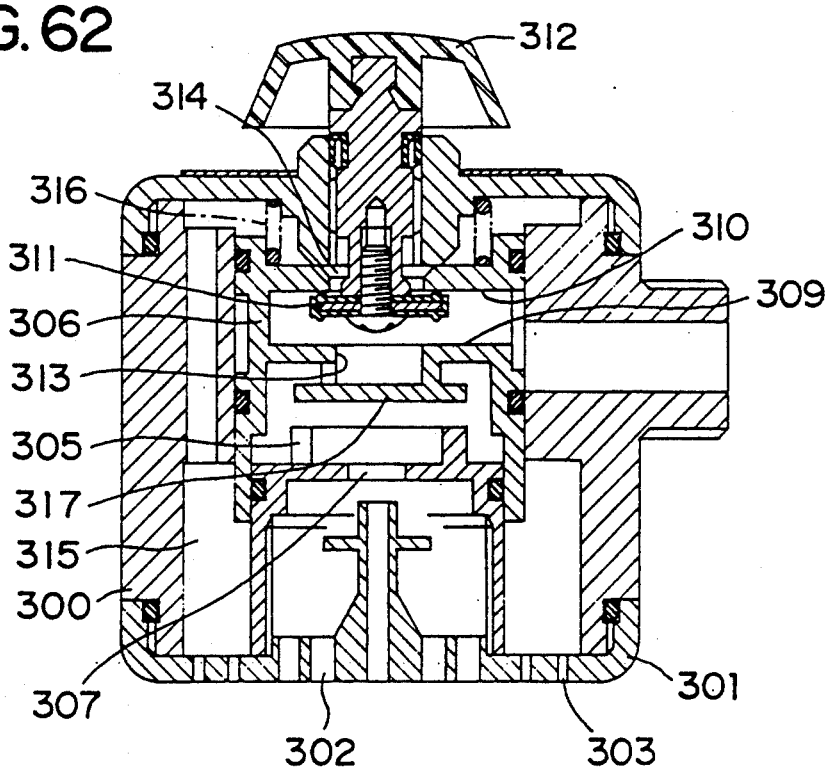
FIG. 62 is a longitudinally sectional view illustrating condition set for discharging an ordinary flow from distributor holes.

Further, when the handle 312 is rotated to move the valve body 311 upwardly, it pulls the selector valve block 306 upwardly, and thus the condition in FIG. 62 is obtained. In this condition, the plate 317 opens the upper end of the swirl chamber 304, and, in a manner similar to that in FIG. 55, the swirling of the flow in the swirl chamber 304 is suppressed. Therefore, the water is not bubbled, and the ordinary flow is discharged from the distributor plate 302.

As described above, by operating the handle 312, the water can be discharged selectively in the form of the bubbly flow, spray flow and ordinary straight flow, so that the outlet device can be used for various purposes such shampoo equipments and kitchen equipments.

Figure 63:
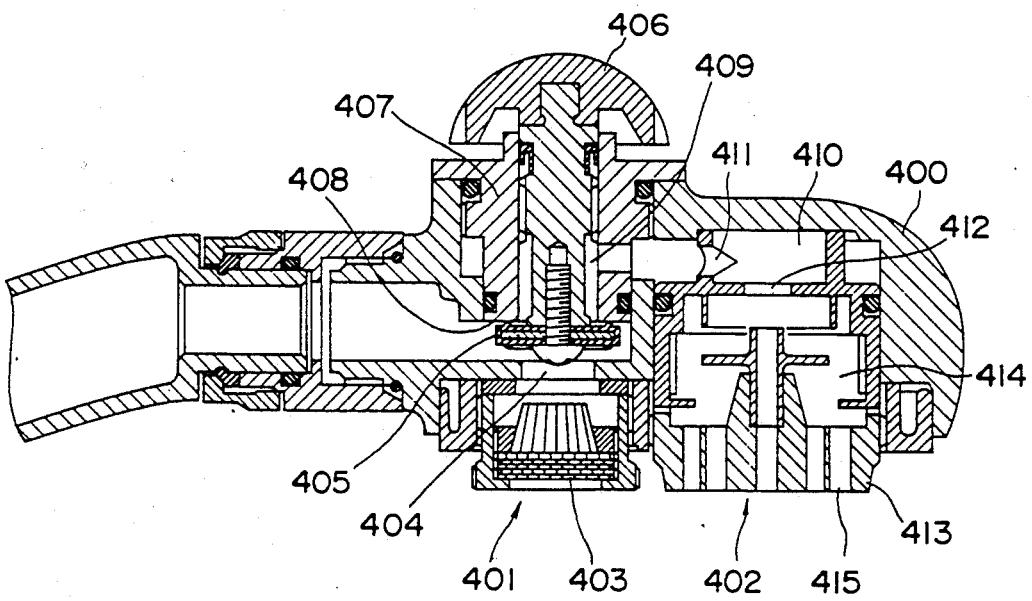
FIG. 63 is a longitudinally sectional view of a major part of another embodiment of a bubbly water outlet device in which a bubbly water flow and an ordinary flow are discharged from different discharge ends, respectively.

FIG. 63 illustrates structures in which the ordinary flow and the bubbly flow are discharged from different discharge ends.

In the Figure, a main body 400 of an outlet head is provided with a discharge port 401 and a bubbly water discharge port 402, which are aligned in this order from the upstream side. The discharge port 401 which is of a cylindrical shape and accommodates a baffle net 403 is in communication with a passage in the main body 400 through a valve hole 404 formed in the main body 400. A selector valve having a valve body 405 coaxial with this valve hole 404 is assembled in the main body 400, and a handle 406 for vertically moving the valve body 405 is attached the outside of it. A selector valve block 407 holding the selector valve has a valve seat 408 at its lower end and also has a communication passage 409 at the inside thereof communicating with the bubbly water discharge port 402.

The bubbly water discharge port 402 is similar to those in the aforementioned embodiments, and includes a swirl chamber 410 having a peripheral wall provided with holes 411. It also includes a discharge port 412 provided at a bottom wall of this swirl chamber 410 as well as a bubbler chamber 414 associated with a distributor plate 413.

In the illustrated condition, the valve body 405 rests on the valve seat 408, so that the water is not supplied to the bubbly water discharge port 402 and the ordinary water flow is discharged from the discharge port 401. When the handle 406 is operated to lower the valve body 405, the valve port 404 for the discharge port 401 is closed and the communication passage 409 for the bubbly water discharge port 402 is opened. Thereby, the water flows into the swirl chamber 410 to be swirled therein, and is bubbled at the bubbler chamber 414 before being discharged from the distributor holes 415 in the distributor plate 413.

Thus, the discharge ends for the ordinary flow and the bubbly flow are located at the separate positions, and the intended flow can be selectively discharged, so that comfortable use can be achieved in respective purposes.

Figure 64:
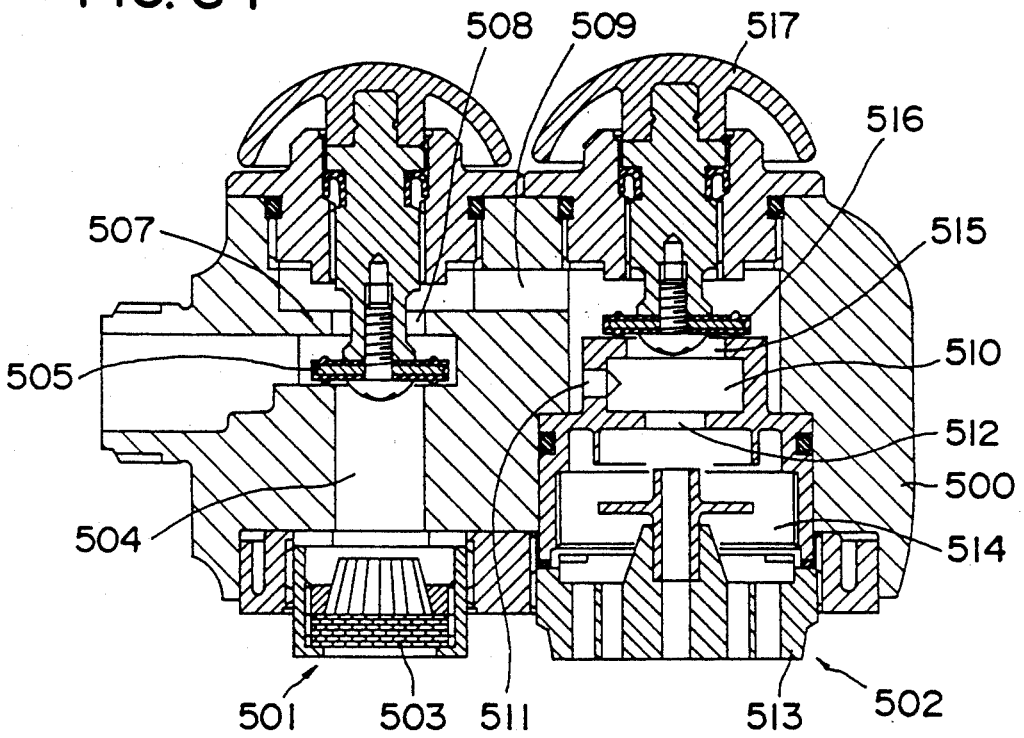
FIG. 64 is a longitudinally sectional view of a major part of another embodiment of a bubbly water outlet device capable of selectively discharging three types of flows.

FIG. 64 illustrates an embodiment in which an ordinary discharge port and a bubbly water discharge port are provided and a straight flow, a bubbly flow and a straight flow including a plurality of straight streams can be selectively discharged. Basic structures are nearly same as those in FIG. 63.

In the Figure, a main body 500 of an outlet head is provided with a discharge port 501 and a bubbly water discharge port 502, which are aligned in this order from the upstream side. The discharge port 501 which is of a cylindrical shape and accommodates a baffle net 503 is in communication with a passage in the main body 500 through a valve hole 504 formed in the main body 500. The discharge port 501 and the bubbly water discharge port 502 are in communication with each other through a valve hole 508 formed in a partition 507 and a communication passage 509 formed downstream to this valve hole 508. A valve body 505 is adapted to selectively rest on a wall around the valve holes 504 and 508 so as to select passage to the discharge port 501 or the bubbly water discharge port 502.

The bubbly water discharge port 502 is similar to those in the aforementioned embodiments, and includes a swirl chamber 510 having a peripheral wall provided with a hole 511 and also includes a discharge port 512 provided at bottom wall of this swirl chamber 510 as well as a bubbler chamber 514 associated with a distributor plate 513. The swirl chamber 510 has an opening 515 at its upper end, and a valve body 516 adapted to be vertically moved by a handle 517 is assembled therein to open and close the opening 515.

In the illustrated condition, the valve body 505 closes the passage to the discharge port 501 and opens the valve hole 507, so that water flows through the communication passage 507 to the bubbly water discharge port 502. Since the opening 515 of the swirl chamber 510 is closed by the valve body 516, the water flows through the hole 511 into the swirl chamber 510. Therefore, in a manner similar to the aforementioned embodiments, the water is supplied through the discharge port 512 into the bubbler chamber 514 and is bubbled therein before being discharged from the distributor holes 518 in the distributor plate 513.

Figure 65:
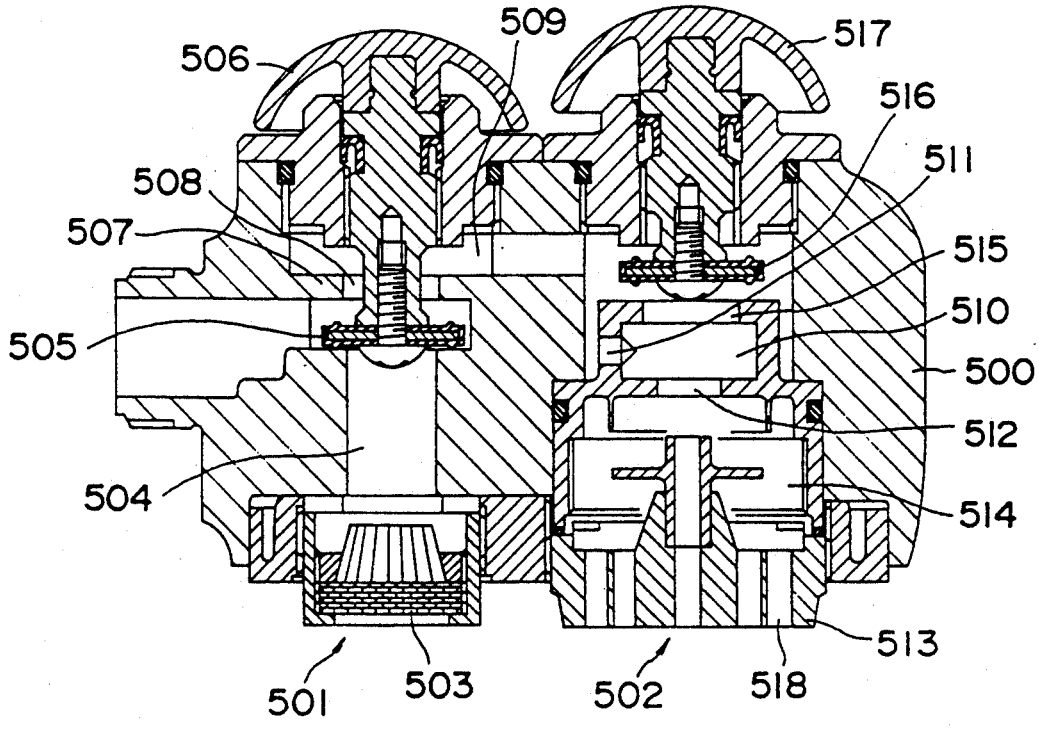
FIG. 65 is a longitudinally sectional view illustrating a condition set for discharging an ordinary flow from distributor holes.
Figure 66:
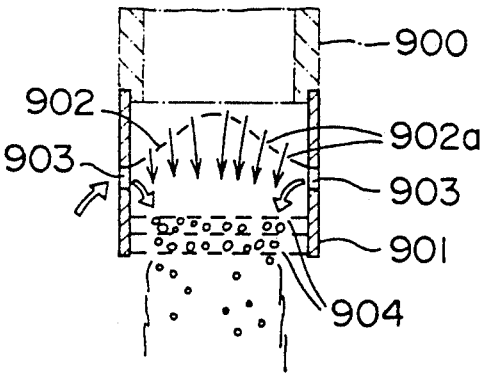
FIG. 66 PRIOR ART
FIG. 66 is a schematic view illustrating structures of a conventional bubbly water outlet.

In FIG. 65, the valve body 516 is raised to open the opening 515, in which case the water is supplied through the hole 511 as well as this opening 515. Therefore, generation of the swirling flow is suppressed similarly to the case in FIG. 55, and the water is discharged in the form of a plurality of straight streams from the distributor holes 518.

Further, when the valve body 505 is raised to close the valve hole 507 and to open the valve hole 504, the passage for the bubbly water discharge port 502 is switched to the passage for the discharge port 501. Therefore, the water is straightened by the baffle net 503 at the discharge port 501 and is discharged in the form of one straight flow.

In this embodiment, by operating the two handles 506 and 517, three types of discharged flows can be selected, and thus they are appropriately switched in accordance with objects for supplying the water and comfortable use can be achieved.

What is claimed is:

1. A bubbly water outlet device comprising:

a swirl chamber connected to a water supply source and being adapted to swirl a flow of water;

a bubbler chamber connected to said swirl chamber through a discharge port provided substantially at a center of said swirl chamber;

said bubbler chamber being provided with an air hole means for sucking in the air from the exterior by virtue of inflow of water from said discharge port, said bubbler chamber having a discharge end, said air hole means projecting from said discharge end of said bubbler chamber into said bubbler chamber.

2. A bubbly water outlet device according to claim 1, further comprising a distributor plate disposed on said discharge end of said bubbler chamber, said distributor plate being rotated by receiving the water supplied from said discharge port.

3. A bubbly water outlet device according to claim 1, wherein said bubbler chamber includes nonreturn means, said nonreturn means comprising first and second nonreturn plates, said first nonreturn plate being an annular nonreturn plate coaxially provided around said discharge port of said swirl chamber, said second nonreturn plate being provided around said air hole means and being co-axial with said first nonreturn plate.

4. A bubbly water outlet device according to claim 1, wherein said bubbler chamber has an inner wall provided with a female thread for receiving the water flow supplied from said discharge port and for interfering with said water flow.

5. A bubbly water outlet device according to claim 1, wherein said bubbler chamber is provided with a cylindrical net against which the water from said discharge port collides, said cylindrical net being located substantially in the flow path of the water flowing toward said discharge end.

6. A bubbly water outlet device according claim 1, wherein said bubbler chamber is provided with an anti-pulsation means for stagnating the water flowing from said discharge port, said bubbler chamber having a lower end with an inner peripheral wall, said anti-pulsation means comprising an annular plate provided at said inner peripheral wall.

7. A bubbly water outlet device comprising:

a swirl chamber connected to a water supply source and being adapted to swirl a flow of water;

a bubbler chamber connected to said swirl chamber through a discharge port provided substantially at a center of said swirl chamber;

a distributor plate for distributing bubbly water flow from said bubbler chamber, said distributor plate having an air inlet opening means for drawing in ambient air from the exterior into said bubbler chamber, said distributor plate having a distribution hole; and a flow straightening means for straightening said bubbly water flow;

said flow straightening means comprising a baffle plate which is disposed in said distributor hole of said distributor plate, said baffle plate dividing the flow passage of said distributor hole into plural sections.

8. A bubbly water outlet device comprising:

a swirl chamber connected to a water supply source and being adapted to swirl a flow of water;

a bubbler chamber connected to said swirl chamber through a discharge port provided substantially at a center of said swirl chamber;

a distributor plate for distributing bubbly water flow from said bubbler chamber, said distributor plate having an air inlet opening means for drawing in ambient air from the exterior into said bubbler chamber;

said distributor plate being provided with a plurality of distributor holes; and guide means for distributing the bubbly water flow to said respective distributor holes, said guide means having a plurality of partitions which introduce the bubbly water flow into the respective distributor holes.

9. A bubbly water outlet device comprising:

a swirl chamber connected to a water supply source and being adapted to swirl a flow of water;

a bubbler chamber connected to said swirl chamber through a discharge port provided substantially at a center of said swirl chamber;

a distributor plate for distributing bubbly water flow from said bubbler chamber, said distributor plate having an air inlet opening means for drawing in ambient air from the exterior into said bubbler chamber, said distributor plate having a side facing said bubbler chamber and a discharge side;

said distributor plate being provided with a plurality of distributor holes;

said distributor holes being tapered holes which converge from said side facing said bubbler chamber toward said discharge side.

10. A bubbly water outlet device comprising:

a swirl chamber connected to a water supply source and being adapted to swirl a flow of water;

a bubbler chamber having a discharge end and being connected to said swirl chamber through a discharge port provided substantially at a center of said swirl chamber;

a distributor plate provided at said discharge end;

said distributor plate having a passage for bubbleless water flow located coaxially with said discharge port and distributor hole means for discharging bubbly water flow independent from said passage for the bubbleless water flow;

a selector valve located between said passage for said bubbleless water flow and said discharge port and operable to select said passage for said bubbleless water flow and said bubbler chamber with respect to said discharge port;

said passage for said bubbleless water flow being operable to suck air therethrough by virtue of inflow of water from said discharge port when said discharge port and said bubbler chamber are in communication with each other.

11. A bubbly water outlet device comprising:

a swirl chamber connected to a water supply source and being adapted to swirl a flow of water;

a bubbler chamber connected to said swirl chamber through a discharge port provided substantially at a center of said swirl chamber, said discharge port leading to a discharge passage;

an air passage provided substantially at a center of said bubbler chamber and being adapted to suck air into said bubbler chamber by virtue of inflow of water from said discharge port into said bubbler chamber;

a passage for discharging a bubbleless water flow connected to said swirl chamber; and a selector valve having a common axis with said swirl chamber and operable to switch between said passage for discharging bubbleless water flow and said discharge passage leading from said discharge port, said selector valve including a valve body disposed in said swirl chamber.

12. A bubbly water outlet device comprising:

a swirl chamber connected to a water supply source and being adapted to swirl a flow of water;

a bubbler chamber connected to said swirl chamber through a discharge port provided substantially at a center of said swirl chamber, said bubbler chamber having a discharge end;

an air passage provided substantially at a center of said bubbler chamber and being adapted to suck air into said bubbler chamber by virtue of inflow of water from said discharge port into said bubbler chamber;

a fixed distributor plate fixed to said discharge end of said bubbler chamber and provided with hole means for bubbly water flow and hole means for bubbleless water flow, said fixed distributor plate also having an air suction hole;

a movable distributor plate rotatably relative to said fixed distributor plate and provided with a water passage hole and an air hole;

said movable distributor plate being operable to selectively take a position in which said water passage hole connects to said hole means for said bubbly water flow and simultaneously said air hole connects to said air suction hole, and a position in which said movable distributor plate closes said air suction hole and said water passage hole connects to said hole means for the bubbleless water flow.

13. A bubbly water outlet device comprising:

a swirl chamber connected to a water supply source and being adapted to swirl a flow of water, said swirl chamber having an upper portion;

a bubbler chamber connected to said swirl chamber through a discharge port provided substantially at a center of said swirl chamber, said bubbler chamber having a discharge end;

a distributor plate at said discharge end;

an air passage means disposed substantially co-axially with said discharge port and being adapted to suck in air into said bubbler chamber by virtue of inflow of water from said discharge port;

a selector chamber means connected to a side of said water supply source means and located at said upper portion of said swirl chamber;

a passage located between said selector chamber means and said swirl chamber for supplying water downwardly into said swirl chamber; and a selector valve operable to open and close said passage located between said selector chamber and said swirl chamber.

14. A bubbly water outlet device comprising:

a swirl chamber connected to a water supply source and operable to swirl a flow of water;

a bubbler chamber connected to said swirl chamber through a discharge port provided substantially at a center of said swirl chamber, said bubbler chamber having a discharge outlet;

air-water passage means provided substantially at the center of said bubbler chamber, said air-water passage means having a discharge end; and a selector valve means operable between a first position and a second position, said selector valve means when in said first position providing communication between said discharge port and said bubbler chamber such that water flows along a first flow path from said discharge port into said bubbler chamber and is then discharged through said bubbler chamber discharge outlet, said air-water passage means being in communication with said bubbler chamber when said selector valve is in said first position such that air is drawn into said bubbler chamber through said air-water passage means when said water flows along said first flow path, said selector valve means when in said second position providing communication between said discharge port and said air-water passage means while precluding communication between said air-water passage means and said bubbler chamber such that the water flows along a second flow path from said discharge port into said air-water passage means and is discharged through said discharge end of said air-water passage means.

15. A bubbly water outlet device according to claim 1, wherein said air hole means has an upper air discharge end for discharging air into said bubbler chamber, said upper air discharge end underlying said discharge port of said swirl chamber, and a cover means overlying said upper air discharge end of said air hole means for preventing ingress of water into said air hole means.

16. A bubbly water outlet device comprising:

a water supply source which provides a flow of water;

a swirl chamber connected to said water supply source and which is operable to receive and to swirl said flow of water;

a bubbler chamber connected to said swirl chamber through a discharge port provided on said swirl chamber;

said bubbler chamber being provided with an air hole means for drawing in ambient air from the exterior by virtue of inflow of water from said discharge port;

said bubbler chamber having a discharge plate means having discharge openings for discharging said water;

said air hole means being provided in said discharge plate means.

17. A bubbly water device comprising:

a water supply source means providing a flow of water;

a swirl chamber connected to said water supply source means;

said swirl chamber comprising swirl chamber walls which define a swirl chamber interior;

swirl-inducing opening means in said swirl chamber walls operable to receive said water flow from said water supply source means and to effect swirling of the water as the water passes into said swirl chamber interior;

said swirl chamber having a swirl chamber discharge;

a bubbler chamber connected to said swirl chamber through said swirl chamber discharge;

said bubble chamber being provided with an air hole means for drawing in ambient air from the exterior;

said bubbler chamber having discharge plate means having discharge openings for discharging said water from said bubble chamber;

said air hole means being provided in said discharge plate means.

18. A bubbly water device according to claim 17, wherein said swirl chamber walls comprise a circular wall, said swirl-inducing means comprising openings in said circular wall which are disposed substantially tangentially to at least a part of said circular wall.

19. A bubbly water device according to claim 17, wherein said swirl chamber walls comprise a circular wall, said swirl-inducing means comprising passages in said circular wall, said passages having central axes which are arcuate.

20. A bubbly water device according to claim 17, wherein said swirl chamber walls comprise a side wall and a top wall, said swirl-inducing means being disposed in said top wall and said side wall.

21. A bubbly water device according to claim 20, wherein said swirl chamber interior has a vertical axis, said swirl-inducing means comprising passages in said top wall, said passages having longitudinal axes nonparallel to said vertical axis.

22. A bubbly water device according to claim 20, wherein said swirl-inducing means in said top wall comprises slits.

23. A bubbly water device according to claim 22, wherein said top wall has an outer periphery, said slits opening up onto said outer periphery.

24. A bubbly water device according to claim 17, wherein said swirl chamber walls comprises a cylindrical wall having a longitudinal axis, said swirl-inducing means comprising axial spaced openings in said cylindrical wall.

* * * * *